US010109966B2

(12) United States Patent
Tsai

(10) Patent No.: US 10,109,966 B2
(45) Date of Patent: Oct. 23, 2018

(54) REVERSIBLE DUAL-POSITION ELECTRIC CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 15/321,373

(22) PCT Filed: Jun. 24, 2015

(86) PCT No.: PCT/CN2015/082256

§ 371 (c)(1),
(2) Date: Dec. 22, 2016

(87) PCT Pub. No.: WO2015/197003

PCT Pub. Date: Dec. 30, 2015

(65) Prior Publication Data

US 2017/0194754 A1 Jul. 6, 2017

(30) Foreign Application Priority Data

Jun. 24, 2014 (CN) ..... 2014 2 0341035 U
Sep. 19, 2014 (CN) ..... 2014 2 0541444 U
Feb. 17, 2015 (CN) ..... 2015 2 0114091 U

(51) Int. Cl.
*H01R 24/00* (2011.01)
*H01R 24/60* (2011.01)
*H01R 13/502* (2006.01)
*H01R 13/6581* (2011.01)
*H01R 107/00* (2006.01)

(52) U.S. Cl.
CPC ..... *H01R 24/60* (2013.01); *H01R 13/502* (2013.01); *H01R 13/6581* (2013.01); *H01R 2107/00* (2013.01)

(58) Field of Classification Search
CPC ..... H01R 24/60; H01R 24/64; H01R 13/642; H01R 13/648; H01R 13/65801; H01R 13/65802; H01R 13/6593
USPC ..... 439/660, 607.01, 607.55, 607.56
See application file for complete search history.

(56) References Cited

U.S. PATENT DOCUMENTS 9,450,342 B2 * 9/2016 Wu ..... H01R 13/6593
9,728,885 B2 * 8/2017 Yokoyama ..... H01R 13/502
2015/0044886 A1 * 2/2015 Little ..... H01R 12/75 439/55

(Continued)

*Primary Examiner* — Hae Moon Hyeon
(74) *Attorney, Agent, or Firm* — WPAT, PC

(57) ABSTRACT

A reversible dual-position electric connector comprises: an insulated seat having a base seat and a docking part fitting together, wherein the docking part has two opposite connection plates to form a fitting frame body, opposite surfaces of the two connection plates have connection surfaces between which a connection slot is formed, and one connection plate has one row of elastic movement spaces much more depressed than the connection surface; one terminal set disposed in the insulated seat and has one row of terminals each having a fixing portion and an extension, which extends to the elastic movement space and is provided with a vertically elastically movable contact; and a metal housing covering the insulated seat and having a four-sided primary housing, which shields the docking part to form a docking structure. A shape of the docking structure can be positioned at a docking electric connector in a reversible dual-position manner.

29 Claims, 20 Drawing Sheets

(56) References Cited

U.S. PATENT DOCUMENTS

| | | | | |
|---|---|---|---|---|
| 2015/0171561 | A1* | 6/2015 | Little | H01R 24/60<br>439/607.34 |
| 2017/0040761 | A1* | 2/2017 | Tsai | H01R 13/642 |
| 2017/0279226 | A1* | 9/2017 | Tsai | H01R 13/6581 |
| 2017/0294749 | A1* | 10/2017 | Tsai | H01R 24/60 |

* cited by examiner

REVERSIBLE DUAL-POSITION ELECTRIC CONNECTOR

BACKGROUND OF THE INVENTION

Field of the Invention

The invention relates to an electric connector, and more particularly to a reversible dual-position electric connector.

Description of the Related Art

Referring to FIGS. 1 and 2 showing a conventional high-definition multimedia interface (HDMI) electric connector comprising a plastic seat 91, two rows of terminals 92 and a metal housing 93, wherein the plastic seat 91 is integrally provided with a base seat 911 and a tongue 912, the tongue 912 projects beyond the front end of the base seat 911, the two rows of terminals 92 are embedded into the plastic seat 91, each of the two rows of terminals 92 are provided with an elastically non-movable contact 921 disposed on top and bottom surfaces of the tongue 912, respectively, and two rows of contacts 921 of the top and bottom surfaces of the tongue 912 respectively contain 10 and 9 contacts cross-interleaving in the left-to-right direction. The two rows of contacts 921 form the HDMI contact interface, the metal housing 93 covers the plastic seat 91, a front section inside the metal housing 93 is formed with a connection slot 95, the tongue 912 is horizontally disposed in the connection slot 95, and the shape of the connection slot 95 is asymmetrical in the top-to-bottom direction to provide the mistake-proof effect, so that the electrical connection can be made at one single position.

A conventional electrical connection socket cannot be easily manufactured because the two rows of terminals 92 are integrally embedded into the plastic seat 91. More particularly, when the specification becomes smaller, the manufacturing precision needs to be very high, and cannot be easily implemented.

Furthermore, the metal housing 93 is a four-sided housing bent from a metal plate sheet to have a seam to affect the shielding effect.

Moreover, the rear shielding shell of the conventional plug is formed by way of metal pulling and extending to form front and rear shielding shells fitting with each other in the front-to-rear direction, so that the manufacturing cost is so high.

Furthermore, disposing two rows of elastically movable terminals on the insulated seat of the conventional dual-position plug with the smaller dimensional specification is not so easy. It is one of main objects of the invention to make the manufacturing process become easier.

Furthermore, the conventional socket and plug are provided with internal ground shielding sheets electrically connected together. However, the conventional socket and plug are provided with two separate ground shielding sheets, so that the assembling becomes more inconvenient and the effect of strengthening the overall structure cannot be provided.

Referring to FIG. 3 showing a side cross-sectional view of docking between a conventional biased MIRCO USB electrical connection plug 20 and a conventional biased MIRCO USB electrical connection socket 90. The biased MIRCO USB electrical connection plug and biased MIRCO USB electrical connection socket are the biased electrical connection plug and electrical connection socket having the minimum height specification specified by USB Association.

The biased MIRCO USB electrical connection socket 90 is provided with a plastic seat 91, one row of five terminals 92 and a metal housing 93, wherein the plastic seat 91 is integrally provided with a base seat 911 and a tongue 912, the tongue 912 projects beyond the front end of the base seat 911, the one row of terminals 92 are embedded into the plastic seat 91, the one row of terminals 92 are provided with elastically non-movable contacts 921 disposed on the bottom surface of the tongue 912, the metal housing 93 covers the plastic seat 91, a front section inside the metal housing 93 is formed with a connection slot 95, and the tongue 912 is horizontally disposed above an upper position of the connection slot 95, so that the connection slot 95 is formed with a small space 951 and a large space 952 on two opposite surfaces of the tongue 912.

The biased MIRCO USB electrical connection plug 20 is provided with an insulated seat 21, a metal housing 22 and one row of five terminals 23, the metal housing 22 covers the insulated seat 21, and the connection portion of the biased electrical connection plug is provided with a fitting slot 24 fitting with the tongue 921 and a fitting interface substrate 25 fitting with the large space 952. The fitting interface substrate 25 has an outer layer being the metal housing, and an inner layer being the insulated seat. The one row of five terminals 23 are provided with vertically elastically movable contacts 231. The contact 231 projects from the inner surface of the fitting interface substrate 25 to the fitting slot 24.

In the biased micro universal serial bus (MICRO USB) electrical connection socket 90 specified by USB Association, the tongue 921 has a height of 0.6 mm, the small space 951 has a height of 0.28 mm and the large space 952 has a height of 0.97 mm, and the connection slot 16 has a height of 1.85 mm.

In the biased MICRO USB electrical connection plug 20 specified by USB Association, the connection portion has a height of 1.8 mm, the fitting slot 24 has a height of 0.65 mm, the metal housing 22 has a thickness of 0.25 mm, and the fitting interface substrate 25 has a height of 0.9 mm.

Referring to FIG. 4 showing a side cross-sectional view showing docking between a conventional dual-position MIRCO USB electrical connection plug 20' and a dual-position MIRCO USB electrical connection socket 90'. The dual-position MIRCO USB electrical connection socket 90 is substantially the same as the biased MICRO USB electrical connection socket 90, except for the difference that the tongue 912 is horizontally disposed at a middle height of the connection slot 95 so that the connection slot 95 forms symmetrical spaces, each of which is the large space 952 having a height of 0.97 mm, on two opposite surfaces of the tongue 912.

The dual-position MIRCO USB electrical connection plug 20' is substantially the same as the biased MICRO USB electrical connection plug 20 except for the difference that the top of the fitting slot 24 is also provided with a fitting interface substrate 25 fitting with the large space 952, and the upper fitting interface substrate 25 is also provided with one row of five terminals 23.

So, the height of the connection portion of the dual-position MIRCO USB electrical connection plug 20' is equal to 2.45 mm, which is equal to the height (0.65 mm) of the fitting slot 24 plus a double of a height (0.9 mm) of the fitting interface substrate 25.

SUMMARY OF THE INVENTION

A main object of the invention is to provide a reversible dual-position electric connector, wherein the insulated seat is provided with a base seat and a docking part fitting with each other, so that elastically movable terminal sets can be easily disposed upon manufacturing.

Another main object of the invention is to provide a reversible dual-position electric connector, wherein the rear shielding shell is composed of two housings vertically combined together, and each of the two housings is provided with a chamber without a combination gap, so that the easy manufacturing and the good shielding effect can be achieved.

Still another main object of the invention is to provide a reversible dual-position electric connector, wherein the outside of the docking part is fixedly provided with a metal sheet correspondingly covering the seam of the four-sided primary housing, so that the four-sided primary housing has no exposed gap.

With the above-mentioned structure to achieve the above-identified objects, the invention provides a reversible dual-position electric connector, comprising: an insulated seat provided with a base seat and a docking part fitting with each other, wherein the docking part is provided with two connection plates facing each other in a vertical direction, and is provided with two side plates connected to the two connection plates to form a fitting frame body, each of opposite surfaces of the two connection plates is provided with a connection surface, and a connection slot is formed between the two connection surfaces, wherein at least one connection plate is provided with one row of separately arranged elastic movement spaces much more depressed than the connection surface and is provided with barriers separating the neighboring elastic movement spaces, and a rear end of the docking part is fitted with and positioned at a front end of the base seat; at least one terminal set disposed in the insulated seat, wherein each of the terminal sets is provided with at least one row of terminals, the terminal is provided with a fixing portion and an extension, the fixing portion is fixed to the base seat, the extension is connected to a front end of the fixing portion, the extension extends to the elastic movement space of the connection surface and is provided with a contact projecting beyond the connection surface, the contact is vertically elastically movable, and the contact of the terminal of each of the terminal sets projects from one of the connection surfaces to the connection slot; and a metal housing covering the insulated seat and provided with a four-sided primary housing, wherein the four-sided primary housing shields the docking part to form a docking structure, a shape of the docking structure may be positioned at a docking electric connector in a reversible dual-position manner, the metal housing and the two connection plates form two contact interface substrates, and the contact interface substrate has a height, which is a perpendicular distance from an outer surface of the metal housing to the connection surface.

The invention further provides a reversible dual-position electric connector, comprising: an insulated seat provided with a base seat and a docking part, wherein the docking part is disposed on a front end of the base seat, the docking part is provided with two connection plates facing each other in a vertical direction, each of opposite surfaces of the two connection plates is provided with a connection surface, and a connection slot is formed between the two connection surfaces; at least one terminal set disposed in the insulated seat, wherein each of the terminal sets is provided with at least one row of terminals, the terminal is provided with a fixing portion and an extension, the fixing portion is fixed to the base seat, the extension is connected to a front end of the fixing portion, the extension extends to a connection surface and is provided with a contact, and the contact of the terminal of each of the terminal sets is exposed from one of the connection surfaces; a metal housing covering the insulated seat and provided with a four-sided primary housing, wherein the four-sided primary housing shields the docking part to form a docking structure, and a shape of the docking structure may be positioned at a docking electric connector in a reversible dual-position manner; and a rear shielding shell, which is made of a metal material and covers a rear section of the metal housing and a rear section of the insulated seat, wherein an accommodating space is formed in the rear shielding shell and a front end of the rear shielding shell is provided with a fitting port, the fitting port is fitted with the rear section of the metal housing, the rear shielding shell is composed of two housings vertically combined together, each of the two housings is provided with a seamless chamber, the chambers of the two housings face each other to form the accommodating space.

The invention further provides reversible dual-position electric connector, comprising: an insulated seat provided with a base seat and a docking part, the docking part is disposed on a front end of the base seat, the docking part is provided with two connection plates facing each other in a vertical direction, each of opposite surfaces of the two connection plates is provided with a connection surface, and a connection slot is formed between the two connection surfaces; at least one terminal set disposed in the insulated seat, each of the terminal sets is provided with at least one row of terminals, the terminal is provided with a fixing portion and an extension, the fixing portion is fixed to the base seat, the extension is connected to a front end of the fixing portion, the extension extends to a connection surface and is provided with a contact, and the contact of the terminal of each of the terminal sets is exposed from one of the connection surfaces; and a metal housing covering the insulated seat and provided with a four-sided primary housing, the four-sided primary housing shields the docking part to form a docking structure, and a shape of the docking structure may be positioned at a docking electric connector in a reversible dual-position manner; characterized in that an outside of the docking part is fixedly provided with a metal sheet, the metal housing is formed by bending a metal plate sheet, the four-sided primary housing is combined and engaged together on one side to form a seam, and the metal sheet correspondingly shields the seam of the four-sided primary housing.

In the above-mentioned reversible dual-position electric connector, the at least one terminal set comprises two terminal sets, wherein the contacts of the terminals of the two terminal sets are disposed on the two connection surfaces, respectively.

In the above-mentioned reversible dual-position electric connector, heights of the two contact interface substrates are smaller than a height of a fitting interface substrate of a biased electrical connection plug having a minimum height specification specified by USB Association and larger than a height of a small space of a connection slot of a biased electrical connection socket having a minimum height specification specified by USB Association, the biased electrical connection plug may dock with the biased electrical connection socket, the biased electrical connection socket is provided with a connection slot, a tongue is disposed in the connection slot in a vertically biased manner, the two corresponding surfaces of the tongue form a large space and the small space, one surface of the tongue facing the large space is provided with one set of contacts, a connection portion of the biased electrical connection plug is provided with a fitting slot and the fitting interface substrate, the fitting slot is fitted with the tongue, and the fitting interface substrate is fitted with the large space.

In the above-mentioned reversible dual-position electric connector, a total height of the docking structure is smaller than a total height obtained by adding a height of the fitting slot and a double of a height of the fitting interface substrate of the biased electrical connection plug having the minimum height specification specified by USB Association.

In the above-mentioned reversible dual-position electric connector, the at least one connection surface is projectingly provided with one front row of contacts and one rear row of contacts, the two rows of contacts are vertically elastically movable, and at least one row of contacts of the two rows of contacts are the contacts of the terminal set.

In the above-mentioned reversible dual-position electric connector, the at least one terminal set comprises two terminal sets, the contacts of the terminals of the two terminal sets respectively project beyond the two connection surfaces, the base seat of the insulated seat is provided with a first base seat and a second base seat directly stacked together, and the two terminal sets are respectively fixedly disposed on the first and second base seats.

In the above-mentioned reversible dual-position electric connector, the reversible dual-position electric connector is one of (a) to (g) or a combination of more than one of (a) to (g):

(a) wherein the one row of elastic movement spaces of the connection plate have bottom surfaces separated from the metal housing;

(b) wherein a front of the base seat is provided with a jointing portion, a front end of the docking part is an inserting port and the rear end of the docking part is a fitting port, and the fitting port is fitted with the jointing portion;

(c) wherein the front of the base seat is provided with the jointing portion, the front end of the docking part is the inserting port and the rear end of the docking part is the fitting port, the fitting port is fitted with the jointing portion, two sides of the jointing portion are provided with frontwardly projecting side portions, and a notch is formed between the two side portions;

(d) wherein the insulated seat is positioned and provided with two ground shielding sheets each made of a metal material, each of front ends of the two connection plates of the fitting member or each of portions near the front ends of the two connection plates of the fitting member is provided with an opening, each of the two ground shielding sheets forming a gap is provided with at least one contact, and the contacts respectively pass through the openings of the two connection plates and project beyond the two connection surfaces and are vertically elastically movable;

(e) wherein the docking part comprises upper and lower housings connected together, the upper and lower housings are respectively embedded into a ground shielding sheet made of a metal material, each of the two ground shielding sheets is provided with and the contacts respectively project beyond the two connection surfaces, and the contacts of the two ground shielding sheets are vertically elastically movable;

(f) wherein a middle of the base seat of the insulated seat is provided with a metal partition plate, each of two sides of the metal partition plate is integrally provided with a resilient snap, the two resilient snaps are elastically movable in a left-right direction and portions near free ends of the two resilient snaps are provided with two snapping convex portions disposed on two sides of the connection slot, each of two sides of the docking part is provided with an opening, and when the two resilient snaps elastically move in the left-right direction, the two openings can provide spaces for the two resilient snaps; and (g) wherein the docking part comprises upper and lower housings connected together, and the upper and lower housings are respectively embedded into a reinforcement sheet.

In the above-mentioned reversible dual-position electric connector, the insulated seat positioned and provided with two ground shielding sheets each made of a metal material, each of the two ground shielding sheets, which form a gap, is provided with at least one contact, and the contacts are respectively exposed from the two connection surfaces.

In the above-mentioned reversible dual-position electric connector, the two ground shielding sheets are integrally connected together to form a ground shielding member.

In the reversible dual-position electric connector according to claim 11, the reversible dual-position electric connector is one of (a) to (d) or a combination of more than one of (a) to (d):

(a) wherein two sides of the two ground shielding sheets of the ground shielding member are connected together through two side sheets to form a four-sided housing, the ground shielding member is fitted with and positioned outside the insulated seat, and each of the two connection plates provided with openings, thorough which the contacts of the two ground shielding sheets respectively pass and are exposed from the two connection surfaces;

(b) wherein the contacts of the two ground shielding sheets are made of elastic sheets bent reversely from front ends and are projectingly curved, and the contacts of the two ground shielding sheets respectively project beyond the two connection surfaces and are vertically elastically movable;

(c) wherein the contacts of the two ground shielding sheets respectively project beyond the two connection surfaces and are vertically elastically movable; and (d) wherein the two connection surfaces have front sections and rear sections higher than the front sections so that the connection slot forms a front section and a rear section lower than the front section, the contacts of the two ground shielding sheets are respectively exposed from the front sections of the two connection surfaces, and the contacts of the two terminal sets are respectively exposed from the rear sections of the two connection surfaces and are closer to a middle height of the connection slot than the contacts of the two ground shielding sheets.

In the above-mentioned reversible dual-position electric connector, a middle of the base seat of the insulated seat is provided with a metal partition plate, the metal partition plate separates the two terminal sets, each of two sides of the metal partition plate is integrally provided with a resilient snap, and the two resilient snaps are elastically movable in a left-right direction and each of portions near free ends of the two resilient snaps is provided with a snapping convex portion laterally convex inwards, wherein the snapping convex portions are disposed on two sides of the connection slot.

In the above-mentioned reversible dual-position electric connector, the reversible dual-position electric connector is one of (a) to (c) or a combination of more than one of (a) to (c):

(a) wherein the metal partition plate is provided with at least one pin for electrical connections to form ground shielding;

(b) wherein a rear end of the resilient snap has a plate surface perpendicularly connected to the metal partition plate; and (c) wherein the snapping convex portion is substantially disposed at a middle height of the connection slot.

In the above-mentioned reversible dual-position electric connector, a height of the snapping convex portion is greater than a material thickness of the metal partition plate, the resilient snap is provided with a bent portion so that a vertical step is formed between the front section and the rear end.

In the above-mentioned reversible dual-position electric connector, the reversible dual-position electric connector is one of (a) to (d) or a combination of more than one of (a) to (d):

(a) wherein a rear end of the resilient snap has a plate surface perpendicularly connected to the metal partition plate;

(b) wherein the plate surface of the resilient snap and a plate surface of the metal partition plate have the same thickness and are disposed on the same plane, and the snapping convex portion is formed by drawing and pulling a plate surface to form a larger height;

(c) wherein the snapping convex portion is formed by stacking two plate surfaces of the resilient snap to form a larger height; and (d) wherein a middle height of the snapping convex portion is substantially disposed at a middle thickness of the metal partition plate.

In the above-mentioned reversible dual-position electric connector, a rear end of the base seat of the insulated seat is provided with a fitting slot, the fitting slot is snapped to and positioned with a circuit board, the circuit board is provided with at least two rows of circuit connection points, and the terminals of the two terminal sets are provided with pins each electrically connected to one of the circuit connection points.

In the above-mentioned reversible dual-position electric connector, the reversible dual-position electric connector is further provided with a rear shielding shell, the rear shielding shell is made of a metal material and covers a rear section of the metal housing and a rear section of the insulated seat, an accommodating space is formed in the rear shielding shell and a front end of the rear shielding shell is provided with a fitting port, and the fitting port is fitted with the rear section of the metal housing, characterized in that the rear shielding shell is composed of two housings vertically combined together, each of the two housings is provided with a seamless chamber, and the chambers of the two housings face each other to form the accommodating space.

In the above-mentioned reversible dual-position electric connector, the reversible dual-position electric connector is one of (a) to (g) or a combination of more than one of (a) to (g):

(a) wherein a rear end of the rear shielding shell is provided with a fitting port;

(b) wherein the chambers of the two housings of the rear shielding shell are formed by a metal sheet and by way of drawing extension molding, are formed by way of metal die casting, or are formed way of metal powder injection molding;

(c) wherein one of left and right sides of the two housings of the rear shielding shell are integrally connected together, and the other of the left and right sides of the two housings of the rear shielding shell are stacked together;

(d) wherein a circuit board and an electronic unit is disposed in the rear shielding shell, the terminals of the at least one terminal set and the electronic unit are electrically connected to the circuit board, and the terminals of the at least one terminal set and the electronic unit form electrical connections through the circuit board;

(e) wherein the rear section of the metal housing is integrally provided with a convex shell more convex in a top-bottom direction than the four-sided primary housing, the fitting port is fitted with a rear section of the four-sided primary housing, and a height of the fitting port is smaller than a height of the accommodating space;

(f) wherein the rear section of the metal housing is integrally provided with the convex shell more convex in the top-bottom direction than the four-sided primary housing, and the fitting port is fitted with the convex shell; and (g) wherein the rear end of the rear shielding shell is provided with another fitting port, the another fitting port fitted with a rear section of a metal housing of an electric connector, a circuit board is disposed in the rear shielding shell, the terminals of the at least one terminal set and the electric connector are electrically connected to the circuit board, the terminals of the at least one terminal set and the electric connector form electrical connections through the circuit board so that mutual adaptation is achieved.

In the above-mentioned reversible dual-position electric connector, a periphery of the chamber is provided with a combination plate, and the combination plates of the two housings are vertically combined together.

In the above-mentioned reversible duplex electric connector, the reversible dual-position electric connector is one of (a) to (d) or a combination of more than one of (a) to (d):

(a) wherein the combination plate of the housing of the rear shielding shell is provided with a snapping sheet snapping to the combination plate of the other housing;

(b) wherein the combination plate of the housing of the rear shielding shell is perpendicularly provided with a bending edge shielding an outside of the combination plate of the other housing;

(c) wherein the combination plate of the two housings of the rear shielding shell are hot molten and combined by way of laser welding so that a combination portion forms a seamless combination, or the combination plates of the two housings are locally spot welded and combined together; and (d) wherein the combination plates of the two housings of the rear shielding shell on one side are integrally connected together and can be folded and combined together.

In the above-mentioned reversible dual-position electric connector, the reversible dual-position electric connector is one of (a) to (g) or a combination of more than one of (a) to (g):

(a) wherein a middle of the base seat of the insulated seat is provided with a metal partition plate, and the metal partition plate separates the two terminal sets;

(b) wherein the contacts of the two terminal sets have the same contact interface;

(c) wherein the four-sided primary housing of the metal housing is top-bottom symmetrical and left-right symmetrical;

(d) wherein the two terminal sets are fixedly embedded into and injected molded with the insulated seat;

(e) wherein the contacts of the two terminal sets having the connection points with the same circuit serial numbers are arranged reversely;

(f) wherein the contacts of the two terminal sets are vertically aligned; and (g) wherein the contacts of the two terminal sets are arranged in an equally spaced manner.

In the above-mentioned reversible dual-position electric connector, the reversible dual-position electric connector is one of (a) to (c) or a combination of more than one of (a) to (c):

(a) wherein a second metal shell is provided to rest against the metal housing, the second metal shell is provided with a four-sided housing, and the four-sided housing is fitted with and rests against the four-sided primary housing;

(b) wherein the two connection plates have the same height; and (c) wherein a coating is further provided to cover the rear section of the metal housing.

In the above-mentioned reversible dual-position electric connector, the elastic movement space is provided with a bottom surface, an extension of an inner end of the contact of the terminal is provided with a fulcrum resting against the bottom surface, the extension of an outer end of the fulcrum does not rest against the bottom surface, and when the contact is pressed to elastically move toward the bottom surface, the contact has a larger normal force by an action of the fulcrum.

The above-mentioned reversible dual-position electric connector is further provided with an adapter medium adapted to an adapted electric connector.

In the above-mentioned reversible dual-position electric connector, the reversible dual-position electric connector is one of (a) to (c) or a combination of more than one of (a) to (c):

(a) wherein the reversible dual-position electric connector further comprises a connection point switching integrated device, so that the contact interface of the dual-position electrical connection plug and the contact interface of the adapted electric connector can be integrated and switched mutually;

(b) wherein the adapted electric connector is a plug or a socket that can be inserted at dual positions; and (c) wherein the adapter medium is an adapter cable or a circuit board.

In the above-mentioned reversible dual-position electric connector, the two terminal sets are fixedly embedded into and injected molded with the first and second base seats, respectively.

The invention has the following advantages.

1. The insulated seat is provided with a base seat and a docking part fitting with each other, so that elastically movable terminal sets can be easily disposed upon manufacturing.

2. The rear shielding shell is composed of two housings vertically combined together, and each of the two housings is provided with a chamber without a combination gap, so that the easy manufacturing and the good shielding effect can be achieved.

3. The outside of the docking part is fixedly provided with a metal sheet correspondingly covering the seam of the four-sided primary housing, so that the four-sided primary housing has no exposed gap.

4. The docking structure has the low-height design to achieve the slim and light effects.

The above-mentioned and other objects, advantages and features of the invention will become more fully understood from the detailed description of the preferred embodiments given hereinbelow and the accompanying drawings.

DETAILED DESCRIPTION OF THE INVENTION

Figure 1:
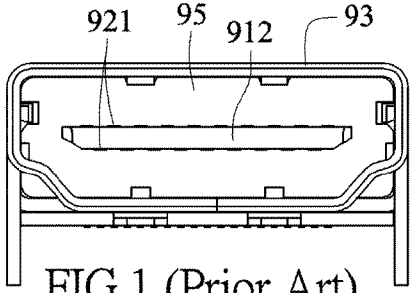
FIG.1 (Prior Art)
FIG. 1 is a front view showing a conventional electric connector.
Figure 2:
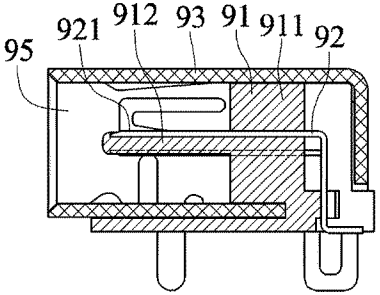
FIG.2 (Prior Art)
FIG. 2 is a side cross-sectional view showing the conventional electric connector.

Referring to FIGS. 5 to 14 showing a dual-position duplex USB TYPE-C electrical connection plug 2 according to the first embodiment of the invention, which comprises an insulated seat 30, two terminal sets, a metal housing 60, a metal partition plate 630, a ground shielding member 640, a circuit board 200 and a rear shielding shell 400.

Referring to FIGS. 5, 7, 11 and 12, the insulated seat 30 is provided with a base seat 31 and a docking part 32.

The base seat 31 is provided with a first base seat 311 and a second base seat 312 directly stacked vertically. The rear section of the base seat 31 is higher and wider than the front section thereof. The front end of the base seat is provided with a jointing portion 304. Two sides of the jointing portion 304 are provided with frontwardly projecting and arced side portions with a notch formed therebetween. Each of the top and bottom surfaces of the middle section of the jointing portion 304 is provided with an engagement block 307. Each of the top and bottom surfaces of the front section of the base seat 31 is provided with two engagement blocks 36. Two sides 313 of the rear section of the base seat 31 backwardly project so that a middle of the rear section of the base seat 31 is formed with a notch 314. Two sides of the base seat 31 are provided with a fitting slot 315. Each of the jointing surfaces of the first and second base seats 311 and 312 is provided with a concave surface 317.

The docking part 32 is a fitting member, which is a fitting frame body having a flat and long shape and two arced sides and approaching a rectangle. The docking part 32 is provided with two connection plates 320 facing each other in a top-to-bottom direction and having the same height, and has two side plates 327 connected to the two connection plates 320 to form a fitting frame body, so that the front end of the docking part 32 is an inserting port 3213, and the rear end of the docking part 32 is a fitting port 3214. The opposite surfaces of the two connection plates 320 are two connection surfaces 323 facing opposite directions. A connection slot 325 is formed between the two connection surfaces 323. Each of rear sections of the inner surfaces of the two connection plates 320 is provided with one row of separate barriers 3210 to separate the space into one row of elastic movement spaces 322. The opposite surfaces of two rows of barriers are rear sections of the two connection surfaces 323. The one row of elastic movement spaces 322 are much more depressed than the rear sections of the two connection surfaces 323 and have bottom surfaces 3211 separated from the metal housing 60. So, the two connection surfaces 323 have the front sections lower than the rear sections, so that the connection slot 325 forms the front section higher then the rear section in the height direction. Each of the portions near the middles of the rear ends of the two connection plates 320 is provided with an engagement hole 321 and has a front end provided with three openings 328, and two side plates each provided with an opening 329.

The fitting port of the rear end of the docking part 32 is fitted with the jointing portion 304 of the base seat 31. The engagement hole 321 engages with the engagement block 307.

Figure 8:
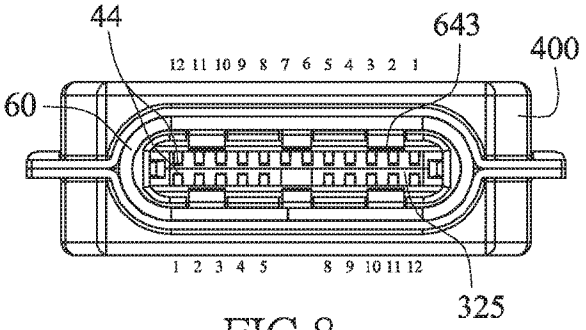
FIG. 8 is a front view according to the first embodiment of the invention.
Figures 11, 12, 13:
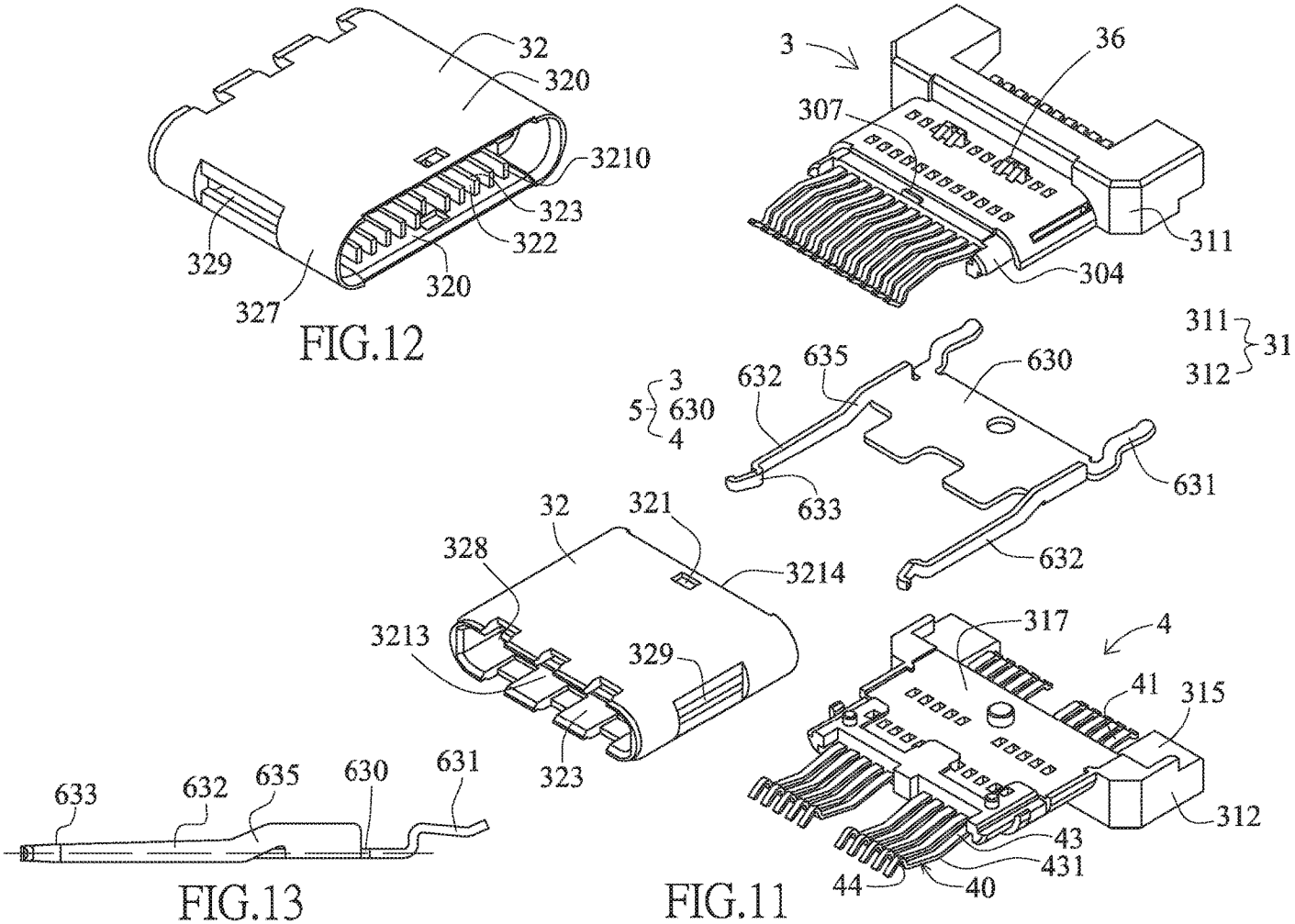
FIG. 11 is a pictorially exploded view showing the insulated seat and a metal partition plate according to the first embodiment of the invention.
FIG. 12 is a pictorial view showing a docking part according to the first embodiment of the invention.
FIG. 13 is a side view showing the metal partition plate according to the first embodiment of the invention.

The two terminal sets include one row of 12 first terminals 40 fixedly embedded into and injected molded with the first base seat 311 to form a first combination 3, and one row of 10 first terminals 40 fixedly embedded into and injected molded with the second base seat 312 to form a second combination 4, wherein the first combination 3 and the second combination 4 are mutually stacked together to form the total combination 5. Each first terminal 40 is sequentially provided with, from one end to the other end, a pin 41, a fixing portion 42 and an extension 43. The fixing portion 42 is directly fixed to the base seat 31. The extension 43 is connected to the front end of the fixing portion 42, extends to the position in front of the base seat 31, is covered by the docking part 32, and is vertically elastically movable in the elastic movement space 322. A portion of the extension 43 near the front end of the extension 43 is curved and projectingly provided with a contact 44. The contact 44 projects from the rear section of the connection surface 323 to the connection slot 325. The middle section of the extension 43 is provided with a fulcrum 431 resting against the bottom surface 3211 of the elastic movement space 322 of the connection plate 320. The pin 41 is connected to the rear end of the fixing portion 42 and extends out of the rear end of the base seat 31, and the contacts of the two rows of first terminals 40 with the same circuit serial numbers are arranged reversely, as shown in FIG. 8. The contacts 44 of the lower terminal set have the connection points with the circuit serial numbers arranged as 1, 2, 3, . . . , 11, 12 from left to right, and the contacts 44 of the upper terminal set have the connection points with the circuit serial numbers arranged as 12, 11, . . . , 3, 2, 1 from left to right. The lower terminal set has 10 terminals, and lacks the terminal with the contacts having the connection points with the circuit serial numbers of 6 and 7.

The contacts of the two terminal sets are vertically aligned, and the contacts of the two terminal sets are arranged in an equally spaced manner.

The fulcrums 431 of the extensions 43 of the two rows of first terminals 40 rest against the connection plate 320 (i.e., rest against the bottom surface of the elastic movement space), so that the elastically movable arm of force has the high structural strength and the good resilience, and the contact 44 has the larger normal force.

The metal partition plate 630 is assembled on the concave surface 317 of the jointing surface between the first and second base seats 311 and 312 and positioned between the first and second base seats 311 and 312 and in the exact middle of the base seat 31 to separate the two terminal sets. Each of the left and right sides of the metal partition plate 630 integrally extends backwards to form a pin 631, and integrally extends frontwards to form a resilient snap 632. The portions of the resilient snaps near the front ends of the resilient snaps are provided with two snapping convex portions 633 disposed on the left and right sides of the connection slot 325. The height of the snapping convex portion 633 is greater than the material thickness of the metal partition plate 630, and the snapping convex portion 633 is substantially disposed at the middle height of the connection slot 325. When the two resilient snaps 632 elastically move in the left-right direction, the openings 329 on the two sides of the docking part 32 may provide the spaces for the two resilient snaps 632. The rear end of the resilient snap 632 has a plate surface vertically connected to the metal partition plate 630, and the rear section of the resilient snap 632 is provided with a bent portion 635 so that a vertical step is formed between the front section and the rear end, and the middle height of the snapping convex portion 633 is substantially disposed at the middle thickness of the metal partition plate 630.

The ground shielding member 640 has a four-sided housing to form a second metal shell. The four-sided housing is a four-sided cover formed by bending a metal plate sheet and provides one side for combination and engagement to form a seam 647. The top and bottom plate sheets of the four-sided housing are two ground shielding sheets 641 forming a gap 6411 equal to the height of the four-sided housing. Each of the rear sections of the two ground shielding sheets 641 is provided with two ribs 649 and two engagement holes 644, and each of the front ends of the two ground shielding sheets 641 is bent inwardly and reversely to form three elastic sheets. Each of the three elastic sheets is curved and projects to form a contact 643. The ground shielding member 640 is fitted with and rests against the front section of the base seat 31 and the docking part 32 of the insulated seat 30. The engagement hole 644 is engaged with the engagement block 36. The contacts 643 of the two ground shielding sheets 641 project from an opening 328 of the docking part 32 to the front sections of the two connection surfaces 323. The contacts of the two terminal sets 44 are respectively exposed from the rear sections of the two connection surfaces 323 and are closer to the middle height of the connection slot 325 than the contacts 643 of the two ground shielding sheets 641.

The metal housing 60 covers the insulated seat 30 and the ground shielding member 640. The metal housing 60 is formed by bending a metal plate sheet and is integrally provided with a four-sided primary housing 61 and a convex shell 612. The convex shell 612 is connected to the rear end of the four-sided primary housing 61, and projects beyond the four-sided primary housing 61 in the top-bottom direction and the left-right direction. The convex shell 612 rests against top and bottom surfaces 319 of the rear section of the first and second base seats of the base seat 31. The four-sided primary housing 61 is combined and engaged together on a plate surface to form a seam 616. The four-sided primary housing 61 is top-bottom symmetrical and left-right symmetrical. The four-sided primary housing 61 shields the docking part 32 to form a docking structure 75 (see FIG. 30). The shape of the docking structure 75 may be reversibly positioned in a docking electric connector at two positions. The convex shell 612 covers the rear section of the base seat 31 and has left and right sides each provided with a fitting slot 615 corresponding to the fitting slot 315 of the insulated seat 30. The top and bottom plates of the rear section of the four-sided primary housing 61 are provided with two engagement holes 62. The engagement hole 62 is engaged with the engagement block 36. The ground shielding member 640 has a four-sided housing to form a second metal shell, which is fitted with and rests against and inside the metal housing 60. A rib 649 can ensure the tight contact with the metal housing 60. A front edge 618 of the metal housing 60 is bent inwardly and stopped at the front edge of the ground shielding member 640.

The metal housing 60 and the two connection plates 320 form two contact interface substrates. The height "a" of the contact interface substrate is the perpendicular distance from the outer surface of the metal housing 60 to the rear section of the connection surface 323. In this embodiment, the height "a" of the two contact interface substrates is about 0.8 mm, and the height "b" of the rear section of the connection slot 325 is about 0.8 mm, so the total height "c" of the docking structure 75 is about 2.4 mm.

Figure 3:
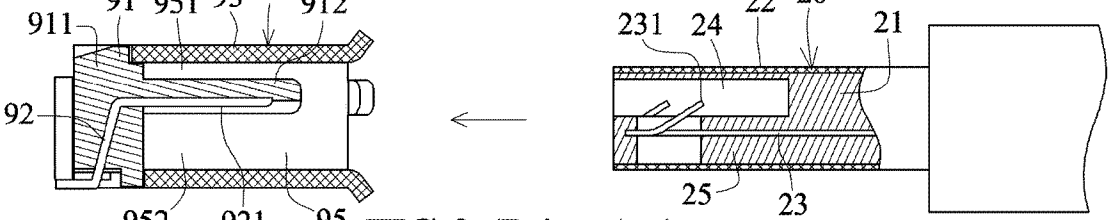
FIG.3 (Prior Art)
FIG. 3 is an exploded side cross-sectional view showing docking between the conventional electrical connection plug and the electrical connection socket.

The height "a" (0.8 mm) of each of the two contact interface substrates is smaller than that of the fitting interface substrate (0.9 mm) of the biased MICRO USB electrical connection plug 20 of FIG. 3 having the minimum height specification specified by USB Association, and is larger than that of the small space (0.28 mm) of the connection slot of the biased electrical connection socket having the minimum height specification specified by USB Association.

Figure 4:
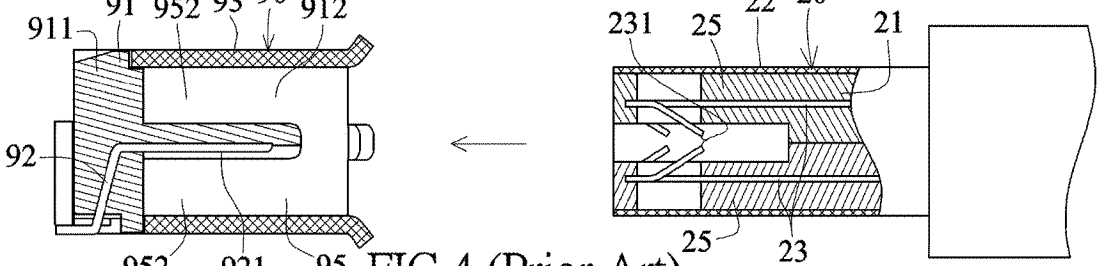
FIG.4 (Prior Art)
FIG. 4 is an exploded side cross-sectional view showing docking between the conventional electrical connection plug and the electrical connection socket.
Figures 5, 6:
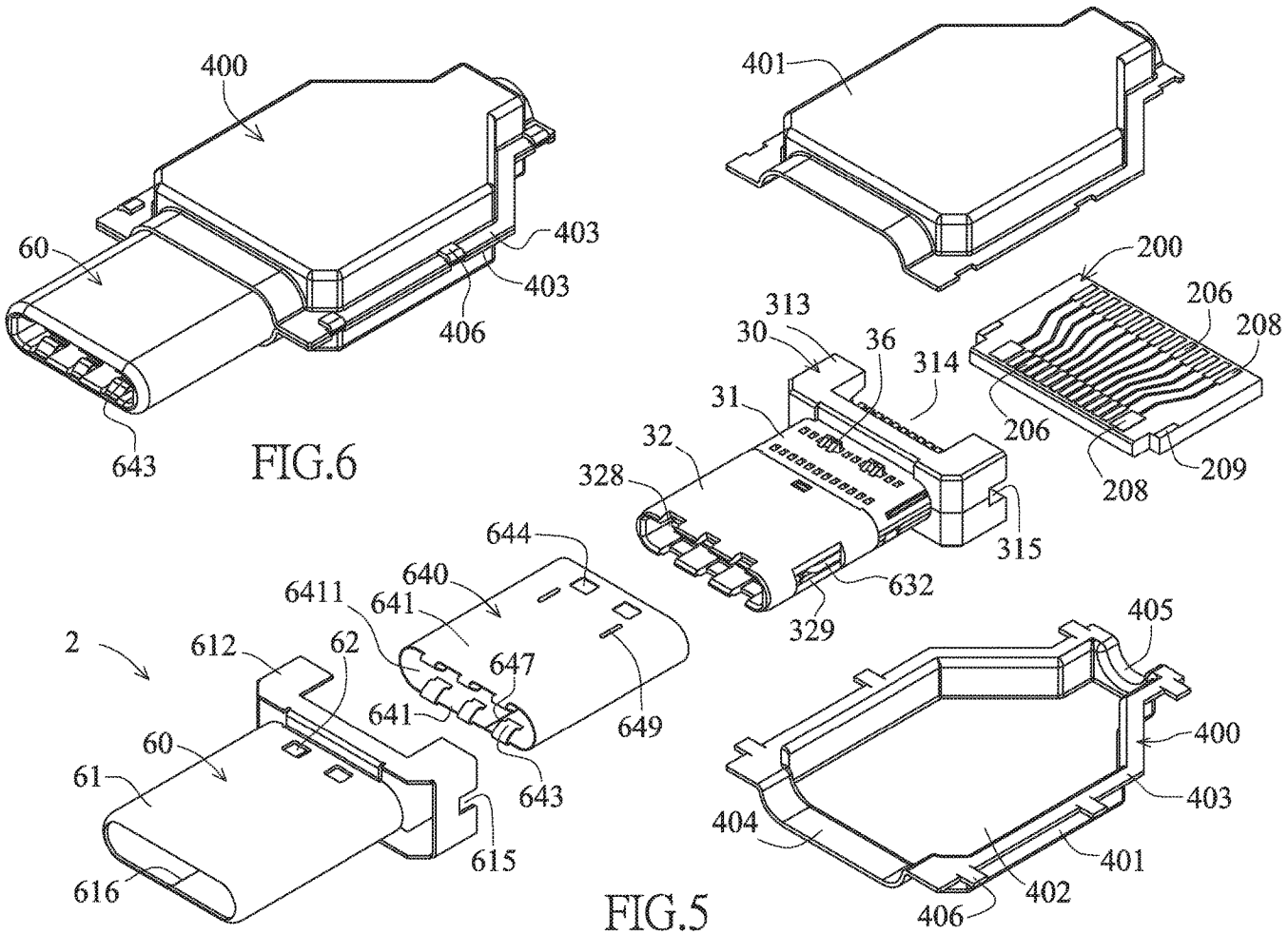
FIG. 5 is a pictorially exploded view according to a first embodiment of the invention.
FIG. 6 is a pictorially assembled view according to the first embodiment of the invention.
Figure 7:
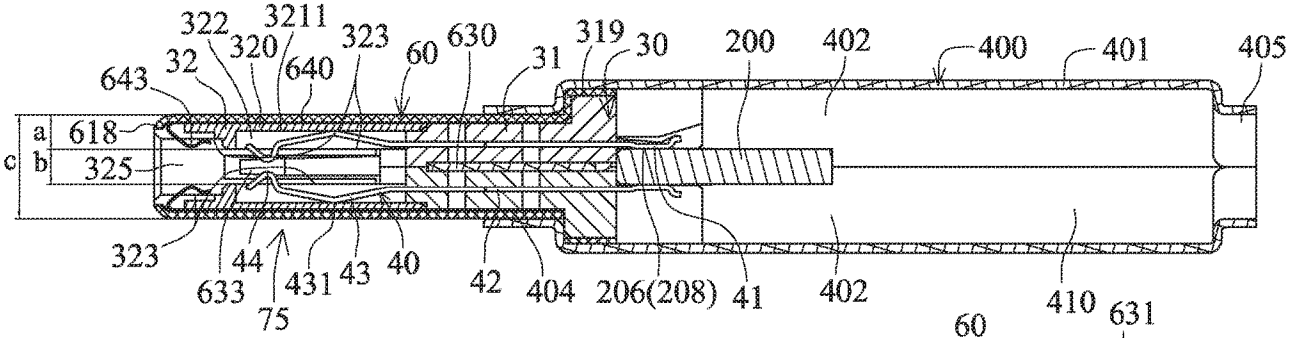
FIG. 7 is a side cross-sectional view according to the first embodiment of the invention.
Figure 9:
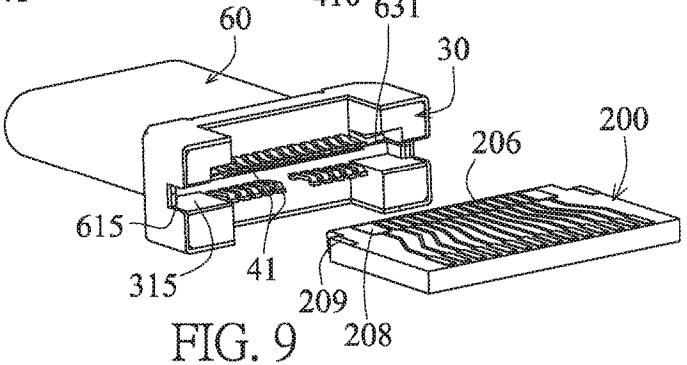
FIG. 9 is a pictorially exploded view showing an insulated seat and a circuit board according to the first embodiment of the invention.
Figure 10:
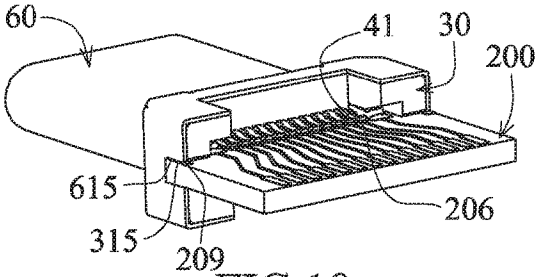
FIG. 10 is a pictorially assembled view showing the insulated seat and the circuit board according to the first embodiment of the invention.

In addition, the total height "c" of the docking structure 75 of this embodiment is about 2.4 mm, and is smaller than the height of the connection portion of the dual-position MIRCO USB electrical connection plug 20' of FIG. 4 (the height of the fitting slot 24 (0.65 mm)+a double of the height of the fitting interface substrate 25 (0.9 mm)=2.45 mm). The height of the connection portion of the dual-position MIRCO USB electrical connection plug 20' is the total height, which is obtained by adding the heights of two fitting interface substrates to the height of one fitting slot of the biased electrical connection plug having the minimum height specification specified by USB Association.

The seam 616 of the metal housing 60 and the seam 647 of the ground shielding member 640 are disposed on the bottom plate surface, but are staggered in the left-right direction so that the two housings can mutually shield the seams.

In addition, the seam 616 of the metal housing 60 and the seam 647 of the ground shielding member 640 may also be implemented as being disposed on the top plate surface and the bottom plate surface, respectively, so that the two housings can mutually shield the seams to reinforce the structure.

Furthermore, the seam 616 of the metal housing 60 and the seam 647 of the ground shielding member 640 may also implemented by way of laser welding and hot melting combination so that the combination portions have no gap.

Referring to FIGS. 5, 7, 9 and 10, the circuit board 200 is a printed circuit board (PCB). Each of the front and rear ends of the top surface of the PCB is provided with one row of connection points 206 and 208 with circuit connections, and each of the front and rear ends of the bottom surface of the PCB is provided with one row of connection points 206 with circuit connections. Each of the left and right sides of the top and bottom surfaces is provided with a wear-resistant pad 209. The left and right sides of the circuit board 200 are snapped to the fitting slots 315 and 615, and the wear-resistant pad 209 may rest against the metal fitting slot 615. The pins 41 of the two terminal sets are respectively bonded to one row of connection points 206 of the front ends of the top and bottom surfaces, and the two pins 631 of the metal partition plate 630 are bonded to the two connection points 208 of the front end of the top surface.

The rear shielding shell 400 is made of a metal material and covers the rear section of the metal housing 60, the rear section of the insulated seat 30 and the circuit board 200. The rear shielding shell 400 is formed with an accommodating space 410 thereinside, and has front and rear ends each provided with fitting ports 404 and 405. The fitting port 404 is fitted with the rear section of the four-sided primary housing 61 of the metal housing. The heights of the fitting ports 404 and 405 are lower than that of the accommodating space 410. The rear shielding shell 400 is composed of two housings 401 vertically combined together. Each of the two housings 401 is provided with a seamless chamber 402. The periphery of the chamber 402 is provided with a combination plate 403. The combination plates 403 of the two housings 401 are vertically combined together. The chambers 402 of the two housings face each other to form the accommodating space 410, wherein the combination plate 403 of one housing 401 is provided with snapping sheets 406 snapping to the combination plate 403 of the other housing 401.

The chambers 402 of the two housings 401 are formed of metal sheets by way of drawing extension molding, are formed by way of metal die casting, or are formed by way of metal powder injection molding.

Figure 14:
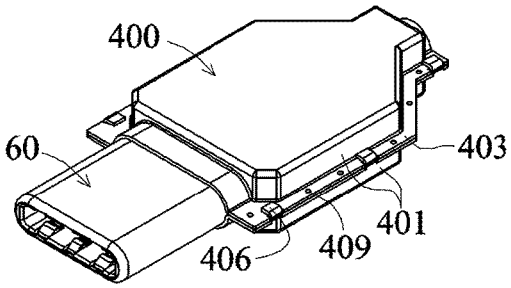
FIG. 14 is a diagram showing the implemented state according to the first embodiment of the invention.
Figure 15:
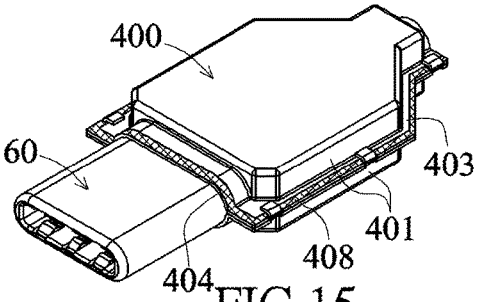
FIG. 15 is a diagram showing the implemented state according to the first embodiment of the invention.

Referring to FIG. 14 upon implementation, the combination plates 403 of the two housings 401 are further formed with the spot welding 409. Referring to FIG. 15, the combination plates 403 of the two housings 401 and the fitting port 404 may further be formed with the laser welding 408 (hatched portion) to implement the hot melting combination so that the combination portion is formed with the seamless combination.

Figure 15A:
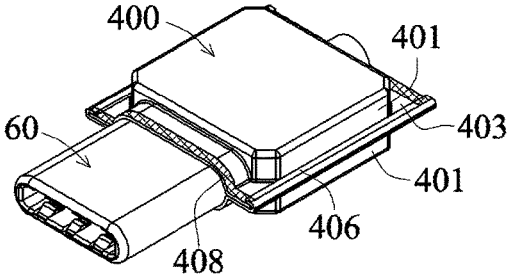
FIG. 15A is a diagram showing the implemented state according to the first embodiment of the invention.
Figure 15B:
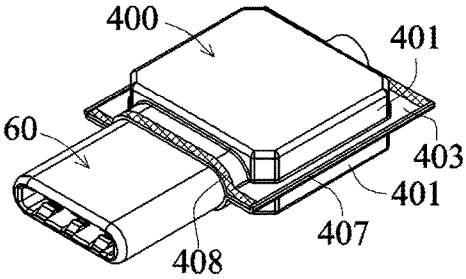
FIG. 15B is a diagram showing the implemented state according to the first embodiment of the invention.
Figure 15C:
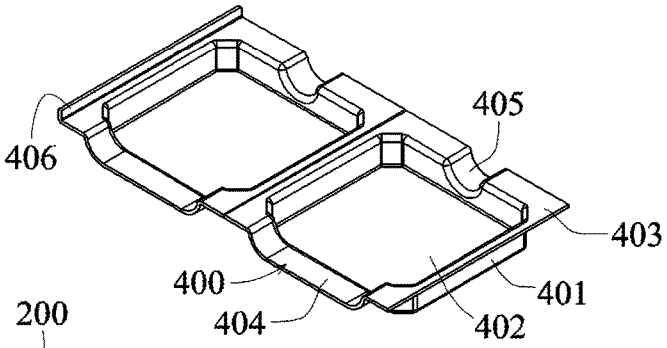
FIG. 15C is a diagram showing the implemented state according to the first embodiment of the invention.
Figure 15D:
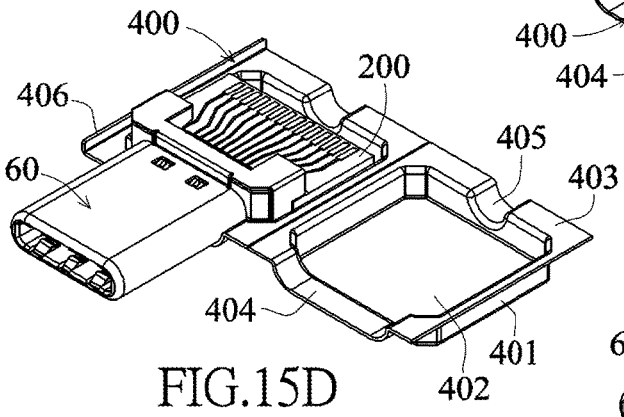
FIG. 15D is a diagram showing the implemented state according to the first embodiment of the invention.
Figure 15E:
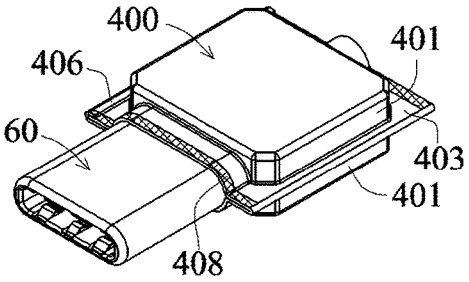
FIG. 15E is a diagram showing the implemented state according to the first embodiment of the invention.

Referring to FIGS. 15A to 15E showing the variations of the rear shielding shell 400 of this embodiment. In FIG. 15A, each of the combination plates 403 of the left and right sides of one housing 401 is provided with a front-to-rear continuous snapping sheet 406 snapping to the combination plate 403 of the other housing 401, and the front and rear ends thereof are the same as FIG. 15. In FIG. 15B, each of the combination plates 403 of the left and right sides of one housing 401 is vertically provided with a front-to-rear continuous bending edge 407 shielding the outside of the combination plate 403 of the other housing 401, and the front and rear ends are the same as FIG. 15A. In FIGS. 15C to 15E, the combination plates 403 of the left and right edges of the two housings 401 are integrally connected together and can be folded and combined together, and the others are the same as FIG. 15A.

Figure 16:
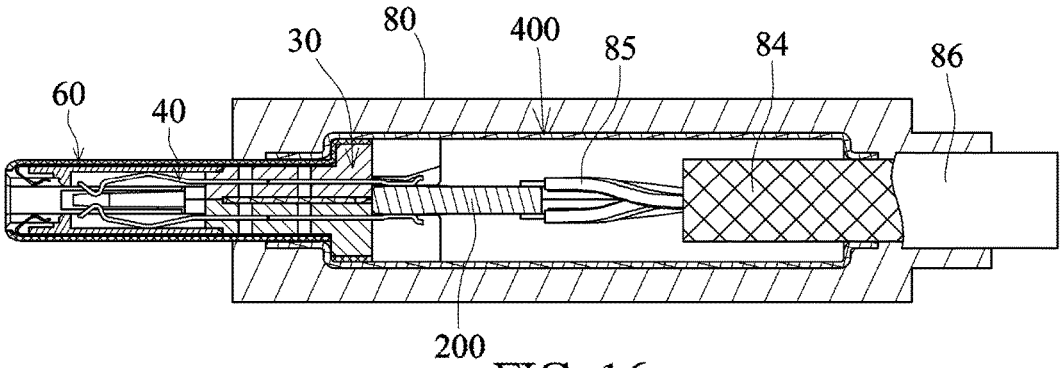
FIG. 16 is a diagram showing the implemented state according to the first embodiment of the invention.

Referring to FIG. 16, the plug of this embodiment serves as the plug of a transmission cable. The transmission cable 86 is an electronic unit provided with two sets of wires 85 bonded to two rows of connection points 206 of the circuit board 200. Metal grid lines 84 covering the two sets of wires 85 are bonded to the two connection points 208 of the circuit board 200 (see FIG. 5), and then encapsulated to form a coating 80.

Figure 17:
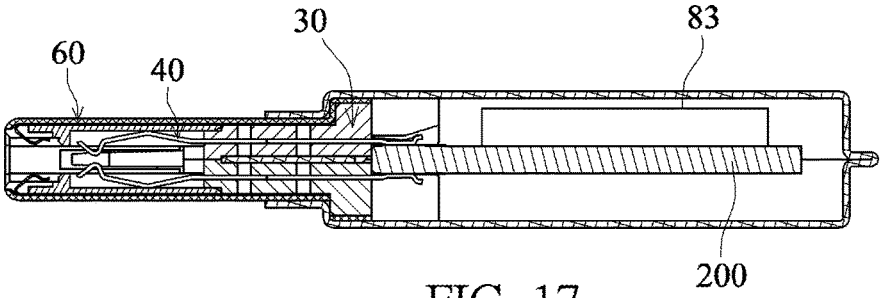
FIG. 17 is a diagram showing the implemented state according to the first embodiment of the invention.
Figure 17A:
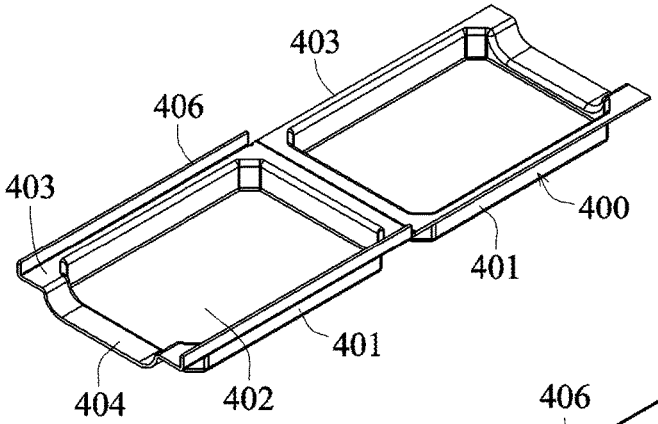
FIG. 17A is a diagram showing the implemented state according to the first embodiment of the invention.
Figure 17B:
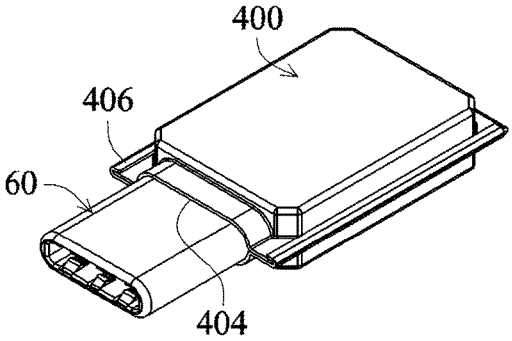
FIG. 17B is a diagram showing the implemented state according to the first embodiment of the invention.

Referring to FIG. 17, this embodiment functions as a plug of a mobile disk. The circuit board 200 needs to be larger, and an electronic unit is disposed on and electrically connected to the circuit board 200. The electronic unit is a storage unit 83 electrically connected to the two terminal sets through the circuit board 200. Referring to FIGS. 17A and 17B, the combination plates 403 of the two ends of the two housings 401 of the rear shielding shell 400 are integrally connected together and can be folded and combined together.

According to the above-mentioned description, the plug of this embodiment has the following advantages:

1. The ground shielding member 640 is integrally provided with two ground shielding sheets 641 to form a four-sided housing, to facilitate the assembling, wherein its four-sided housing and the four-sided primary housing 61 of the metal housing 60 are fitted with and rest against together, so that the structural strength of the metal housing 60 can be reinforced, and the seam can be effectively shielded.

2. The rear shielding shell 400 is formed with the two housings 401 vertically combined together, and each of the two housings 401 is provided with a chamber 402 without a combination gap, so that the easy manufacturing and the good shielding effect can be achieved.

3. The insulated seat 30 is provided with a base seat 31 and a docking part 32 mutually fitted together, wherein the base seat 31 is provided with vertically stacked first and second base seats 311 and 312, which are fixedly embedded into and injected molded with two terminal sets, respectively, so that the elastically movable terminal sets can be easily disposed upon manufacturing.

4. The height of the snapping convex portion 633 of the resilient snap 632 is greater than the material thickness of the metal partition plate 630, and the resilient snap 632 is provided with a bent portion 635 so that a vertical step 635 is formed between the front section and the rear end, and the middle height of the snapping convex portion 633 is substantially disposed at the middle thickness of the metal partition plate 630.

5. The insulated seat 30 provided with the fitting slot 315 can be engaged with the circuit board 200.

6. The docking structure has the low-height design to achieve the slim and light effects.

Figure 18:
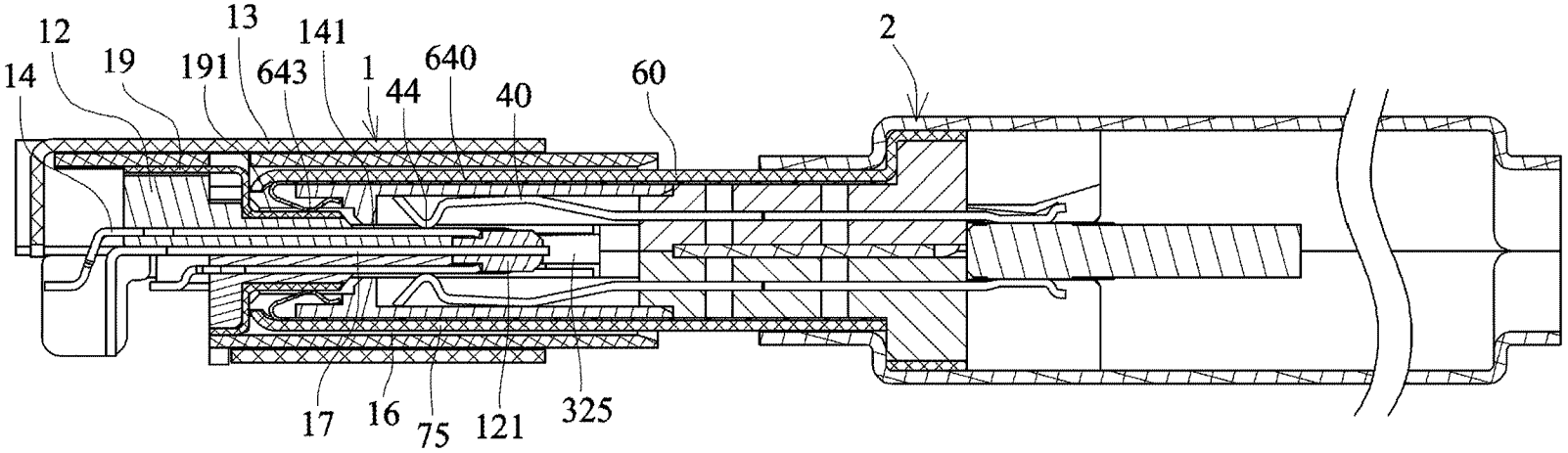
FIG. 18 is a side cross-sectional view showing docking between the first embodiment of the invention and an electric connector.

Referring again to FIG. 18, the plug 2 of this embodiment can be electrically connected to a dual-position duplex USB TYPE-C electrical connection socket 1 in a reversible and duplex dual-position manner to achieve the doubled transmission and easy insertion effects. That is, when the front side or reverse side of the plug 2 is inserted into the connection slot 16 of the socket 1, the contacts 44 of the two terminal sets of the plug 2 are electrically connected to the contacts 141 of the terminals 14 of the two terminal sets of the socket 1, and the tongue 121 of the insulated seat 12 of the socket 1 is connected to the connection slot 325 of the plug 2. The inner sections of the two connection surfaces of the tongue 121 are more convex than the outer sections of the two connection surfaces to fit in conjunction with the front-high-rear-low structure of the connection slot 325. The contact 643 of the ground shielding member 640 of the plug is electrically connected to the first plate sheet 191 of the ground shielding member 19 of the socket, so that the metal housing 60 of the plug 2 is electrically connected to the metal housing 93 of the socket 1.

In addition, the snapping convex portion 633 of the resilient snap 632 of the plug 2 snaps to the slot of a metal partition plate 17 of the socket 1, so that the plug 2 and the socket 1 form the inner snapping.

Figure 20:
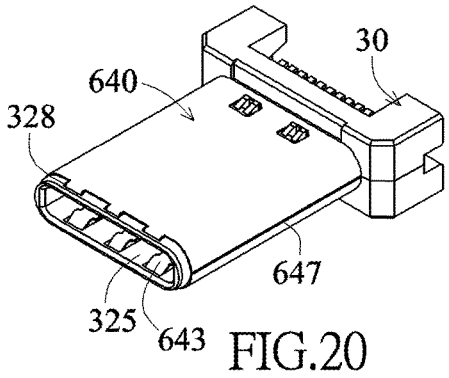
FIG. 20 is a pictorially assembled view according to the second embodiment of the invention.
Figure 19:
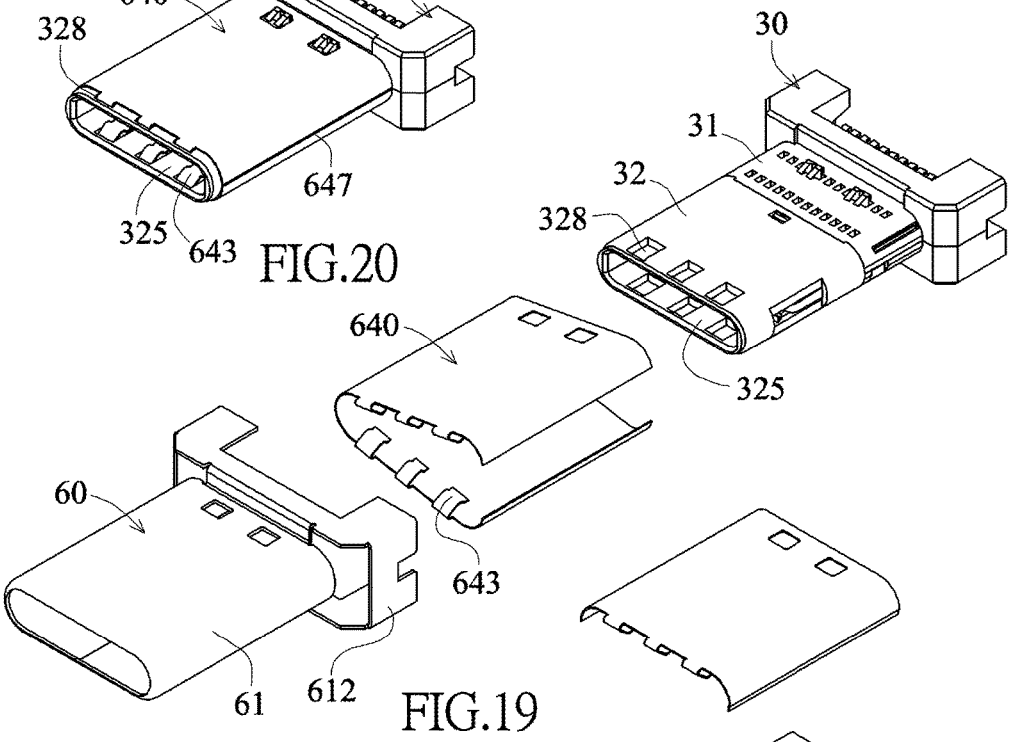
FIG. 19 is a pictorially exploded view according to a second embodiment of the invention.

Referring to FIGS. 19 and 20, the second embodiment of the invention is substantially the same as the plug of the first embodiment except for the difference that the left and right sides of the ground shielding member 640 of the this embodiment are connected together to form the seam 647, so that the opening 328 of the docking part 32 needs not to be disposed on the front end, and the docking part 32 may have the complete front edge.

Figure 21:
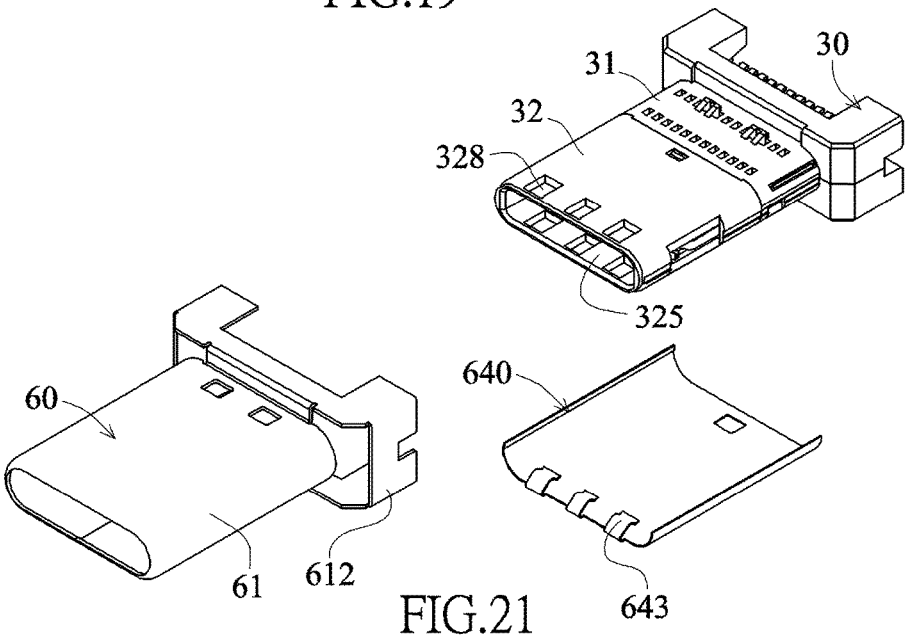
FIG. 21 is a pictorially exploded view according to a third embodiment of the invention.

Referring to FIG. 21, the third embodiment of the invention is substantially the same as the second embodiment except for the difference that the ground shielding member 640 of this embodiment has two half housings vertically connected together.

Figure 22:
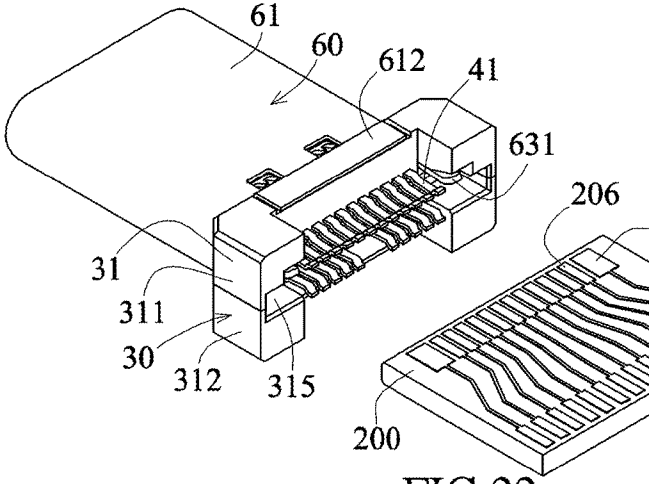
FIG. 22 is a pictorially exploded view showing the insulated seat and the circuit board according to a fourth embodiment of the invention.
Figure 23:
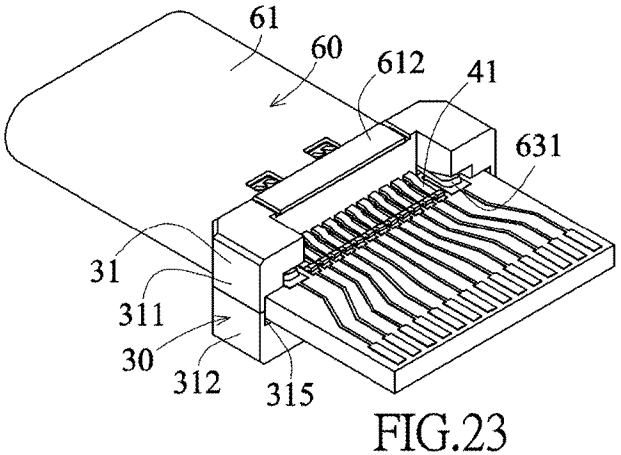
FIG. 23 is a pictorially assembled view showing the insulated seat and the circuit board according to the fourth embodiment of the invention.

Referring to FIGS. 22 and 23, the fourth embodiment of the invention is substantially the same as the plug of the first embodiment except for the difference that the convex shell 612 of the metal housing 60 of this embodiment only projects in the top-bottom direction, to facilitate the metal sheet bending. So, only the left and right sides of the base seat 31 are provided with the fitting slot 315 snapping to the circuit board 200.

Figure 24:
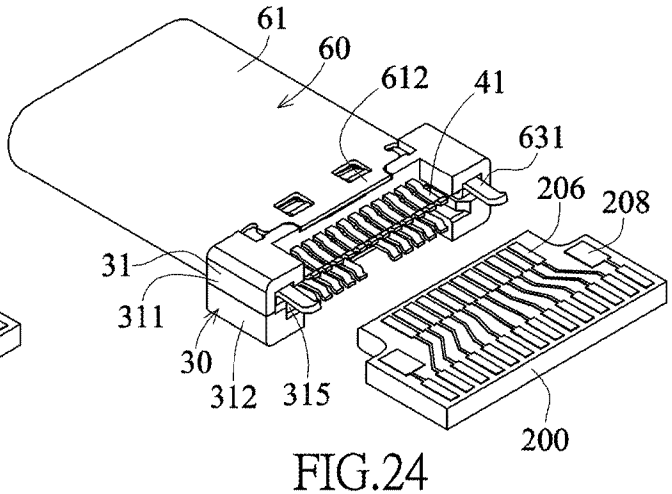
FIG. 24 is a pictorially exploded view showing the insulated seat and the circuit board according to a fifth embodiment of the invention.
Figure 25:
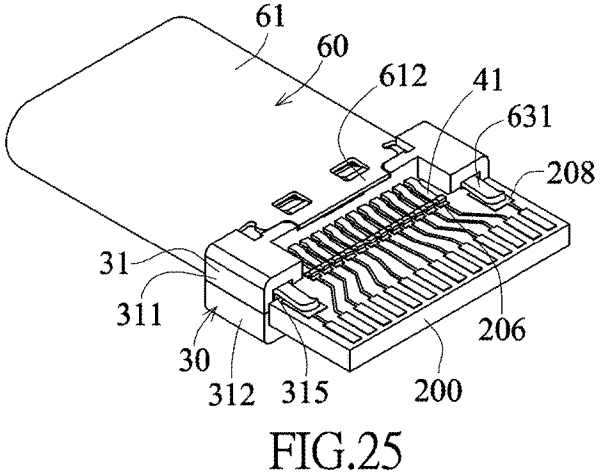
FIG. 25 is a pictorially assembled view showing the insulated seat and the circuit board according to the fifth embodiment of the invention.

Referring to FIGS. 24 and 25, the fifth embodiment of the invention is substantially the same as the fourth embodiment except for the difference that the two pins 631 of the metal partition plate 630 of this embodiment and the pins 41 of a terminal set of the first base seat 311 are arranged in one front row and one rear row. So, the one row of connection points 206 and the two connection points 208 on the circuit board 200 are arranged in one front row and one rear row.

Figure 26:
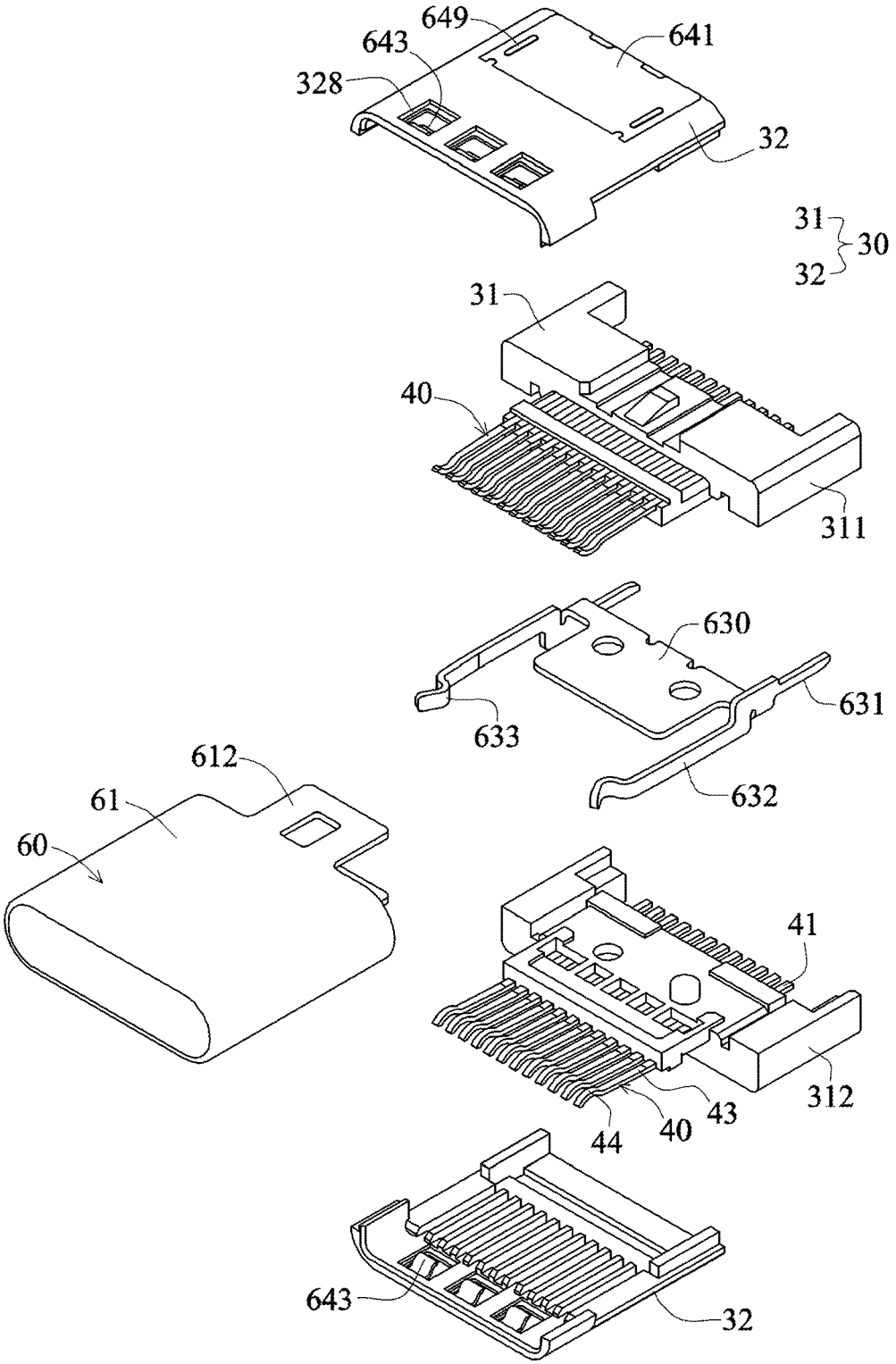
FIG. 26 is a pictorially exploded view according to a sixth embodiment of the invention.
Figure 27:
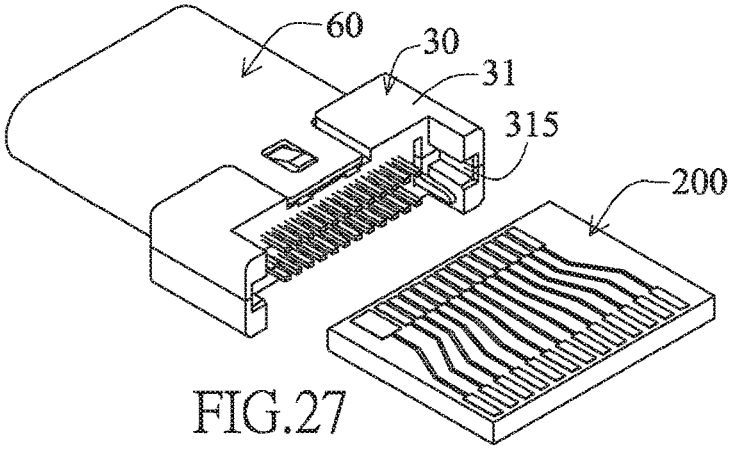
FIG. 27 is a pictorially exploded view showing the insulated seat and the circuit board according to the sixth embodiment of the invention.
Figure 28:
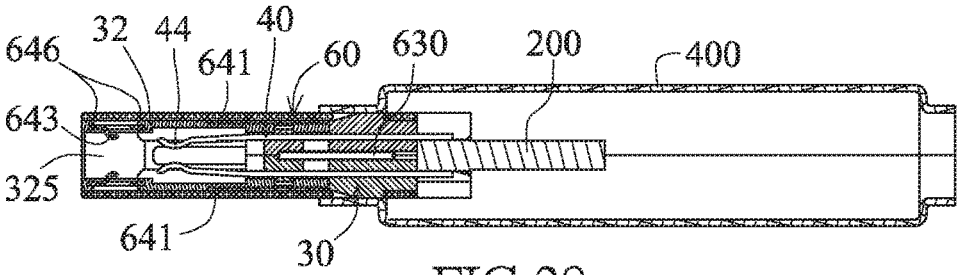
FIG. 28 is a side cross-sectional view according to the sixth embodiment of the invention.

Referring to FIGS. 26 to 28, the sixth embodiment of the invention is substantially the same as the first embodiment and the fifth embodiment except for the difference that the rear ends of two resilient snaps 632 of the metal partition plate 630 of this embodiment are one upper end and one lower end bent to be vertically connected to the metal partition plate 630, so that the middle height of the snapping convex portion 633 of the two resilient snaps 632 is similarly substantially disposed at the middle thickness of the metal partition plate 630, and the two pins 631 are respectively flush with the pins 41 of the two terminal sets.

In addition, the docking part 32 of this embodiment comprises upper and lower housings connected together to form a fitting frame body similar to that of the first embodiment, the upper and lower housings are respectively embedded into a ground shielding sheet 641. Each of the two ground shielding sheets 641 is provided with three contacts 643 respectively projecting from the opening 328 of the docking part 32 to the front sections of the two connection surfaces 323. The three contacts 643 of the two ground shielding sheets 641 are vertically elastically movable. The two ground shielding sheets 641 also function as reinforcement sheets to reinforce the structural strength of the upper and lower housings. At least one portion 646 of the ground shielding sheet 641 is totally embedded into the front section of the fitting frame body to reinforce the structural strength of the inserting port of the fitting frame body.

Figure 29:
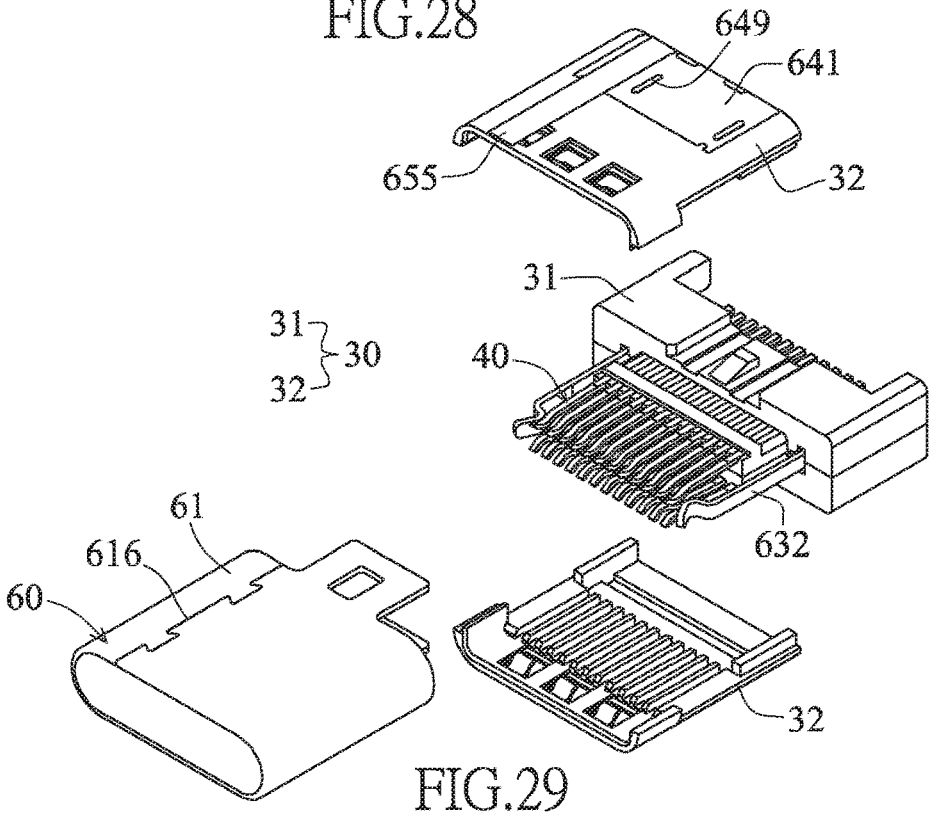
FIG. 29 is a pictorially exploded view according to a seventh embodiment of the invention.

Referring to FIG. 29, the seventh embodiment of the invention is substantially the same as the sixth embodiment except for the difference that the outside of the docking part 32 of this embodiment is fixedly provided with a metal sheet 655. The metal sheet 655 correspondingly shields the seam 616 of the four-sided primary housing 61. The metal sheet 655 may be aluminum platinum directly attached to the docking part 32. The easy configuration of the metal sheet 655 achieves the function of shielding the seam of the four-sided primary housing 61.

Figure 30:
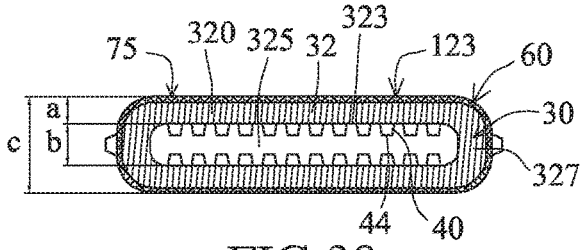
FIG. 30 is a front cross-sectional view according to an eighth embodiment of the invention.

Referring to FIG. 30, the eighth embodiment of the invention provides a dual-position duplex electrical connection plug 123, which is substantially the same as the first embodiment. The external shape of the docking structure 75 of this embodiment is similarly in the form of two arced sides, and the contacts 44 of the two rows of first terminals 40 are vertically aligned except for the difference that this embodiment has no metal partition plate, ground shielding member, circuit board and rear shielding shell.

The height "a" of the contact interface substrate of the dual-position duplex electrical connection plug 123 ranges between 0.65 mm and 0.9 mm. The height "b" of the connection slot 325 ranges from about 0.85 mm to 1.0 mm. The overall height "c" of the docking structure 75 ranges from about 2.2 mm to 2.8 mm, so that the slim and light product can be easily manufactured.

The height "a" of the contact interface substrate of this embodiment is about 0.75 mm, the height "b" of the connection slot 325 is about 0.9 mm, and the overall height "c" of the docking structure 75 is about 2.4 mm.

The height "a" (0.75 mm) of each of the two contact interface substrates is smaller than that of the fitting interface substrate (0.9 mm) of the biased MICRO USB electrical connection plug 20 of FIG. 3 having the minimum height specification specified by USB Association, and is larger than that of the small space (0.28 mm) of the connection slot of the biased electrical connection socket having the minimum height specification specified by USB Association.

In addition, the total height of the docking structure of this embodiment is about 2.4 mm, and is smaller than the height of the connection portion of the dual-position MIRCO USB electrical connection plug 20' of FIG. 4 (the height of the fitting slot 24 (0.65 mm)+a double of the height of the fitting interface substrate 25 (0.9 mm)=2.45 mm). The height of the connection portion of the dual-position MIRCO USB electrical connection plug 20' is the total height, which is obtained by adding the heights of the two fitting interface substrates to the height of one fitting slot of the biased electrical connection plug having the minimum height specification specified by USB Association.

Figure 31:
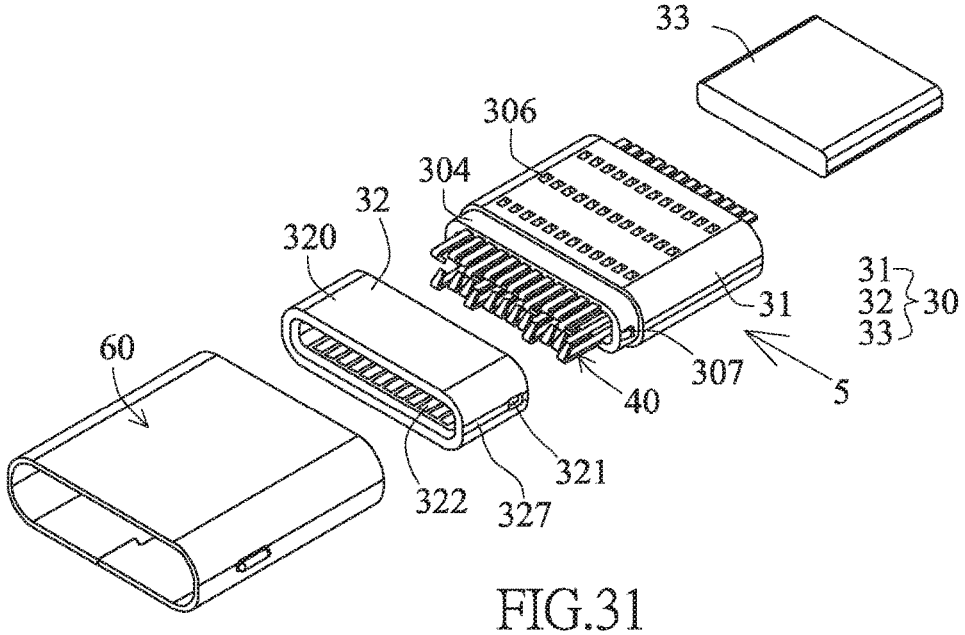
FIG. 31 is a pictorially exploded view according to a ninth embodiment of the invention.
Figure 32:
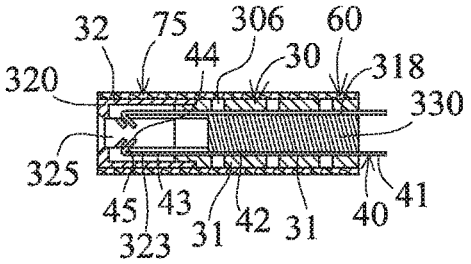
FIG. 32 is a side cross-sectional view according to the ninth embodiment of the invention.
Figure 33:
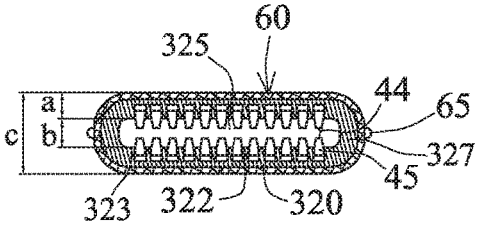
FIG. 33 is a front cross-sectional view according to the ninth embodiment of the invention.

Referring to FIGS. 31 to 33, the ninth embodiment of the invention is a dual-position duplex electrical connection plug and is substantially the same as the first and eighth embodiments except for the differences that the insulated seat 30 comprises a base seat 31, a docking part 32 and an insulation plug block 33, that the two rows of first terminals 40 and the base seat 31 are integrally embedded and injection molded together to form a total combination 5, that the base seat 31 forms a hollow chamber 318, that the fixing portions 42 of each of the one row of first terminals 40 of the two terminal sets are respectively arranged and fixed to the top and bottom surfaces of the hollow chamber 313, that the extensions 43 of the two rows of first terminals 40 extend out to a position in front of the base seat 31, that each of the top and bottom surfaces of the base seat 31 is formed with three rows of cavities 306, that each cavity 306 corresponds to the fixing portion 42 of the first terminal 40, that the end section of the extension 43 of the first terminal 40 is bent reversely to form a reverse extension sheet 45 projecting beyond the connection surface 323, that the cut surface of the distal end of the reverse extension sheet 45 is the contact 44, that the extension 43 is vertically elastically movable, that the reverse extension sheet 45 is shorter and is not elastically movable, that the front end of the base seat 31 is provided with a jointing portion 304, and that each of the left and right sides of the jointing portion 304 is provided with an engagement block 307.

In addition, the extensions 43 of each one row of first terminals 40 have different lengths, and some first terminals 40 have the longer extensions 43, so each of the two connection surfaces 323 is projectingly provided with one front row of contacts 44 and one rear row of contacts 44. The two rows of contacts are vertically elastically movable. The end section of the extension 43 of the first terminal 40 is bent reversely to form the contact 44 projecting beyond the connection surface 323, and the contact 44 is a cut surface of a distal end.

Each of the two terminal sets is one row of 12 first terminals 40. The contacts of the two terminal sets having the same contact interface and the connection points with the same circuit serial numbers are arranged reversely.

The docking part 32 is fitted with the jointing portion 304 of the front end of the base seat 31. The structure of the docking part 32 is almost the same as that of the first embodiment, is similarly provided with two connection plates 320 facing each other in a top-to-bottom direction and having the same height and has two side plates 327 connected to the two connection plates 320 to form a fitting frame body, so that the front end of the docking part 32 is an inserting port and the rear end is a fitting port. The opposite surfaces of the two connection plates 320 are two connection surfaces 323 facing opposite directions. A connection slot 325 is formed between the two connection surfaces 323. Each of the rear sections of the inner surfaces of the two connection plates 320 is provided with one row of separate barriers to separate the space into one row of elastic movement spaces 322 to separate the extensions 43 of the two rows of first terminals 40 of the two contact interfaces. The opposite surfaces of two rows of barriers are two connection surfaces 323. The one row of elastic movement spaces 322 are much more depressed than the connection surface 323 and have bottom surfaces separated from the metal housing 60.

Each of two sides of the rear end of the docking part 32 is provided with an engagement hole 321 engaged with the engagement block 307 of the base seat 303.

The insulation plug block 330 is fitted with the hollow chamber 313 of the base seat 303. The front end of the insulation plug block 330 is formed with a limiting surface to rest and limits against the tongue of the electrical connection socket.

The height "a" of the contact interface substrate of this embodiment is about 0.75 mm, the height "b" of the connection slot 325 is about 0.9 mm, and the overall height "c" of the docking structure 75 is about 2.4 mm.

Figure 34:
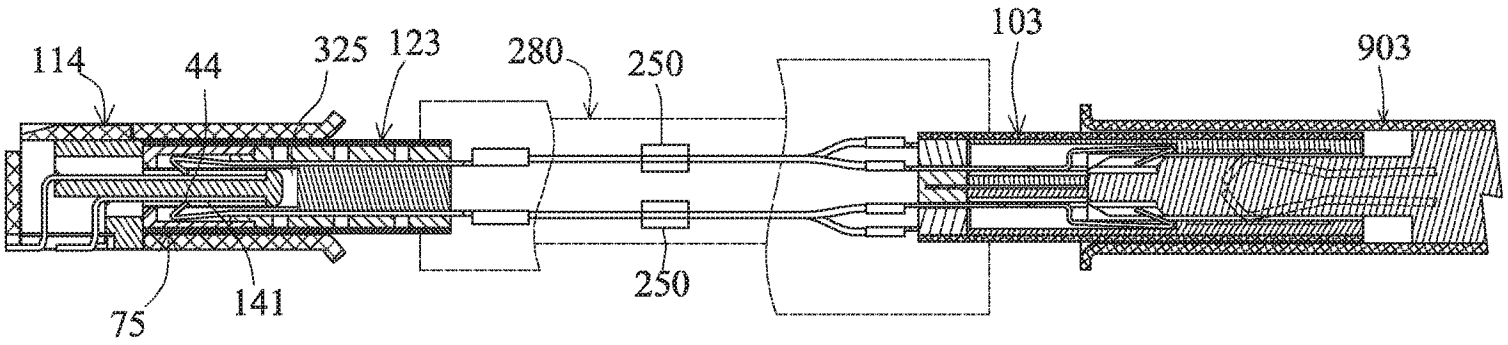
FIG. 34 is a side cross-sectional view according to a tenth embodiment of the invention.

Referring to FIG. 34, the tenth embodiment of the invention is an adapter cable 280 having one end connected to a dual-position duplex USB 3.0 electrical connection plug 103, and the other end adapted into a dual-position duplex electrical connection plug 123 according to the ninth embodiment. The dual-position duplex USB 3.0 electrical connection plug 103 is inserted into a dual-position duplex USB 3.0 electrical connection socket 903 to achieve the doubled transmission. The dual-position duplex electrical connection plug 123 is inserted into a dual-position duplex electrical connection socket 114 to achieve the doubled transmission. The contact 141 of the dual-position duplex electrical connection socket 114 is not elastically movable.

The two contact interfaces of the docking dual-position duplex plug and socket have the same contact interface, and the circuit serial numbers of the connection points of the two contact interfaces are arranged reversely.

The adapter cable of this embodiment needs to be provided with two connection point switching integrated devices 250, so that the two USB 3.0 contact interfaces of the dual-position duplex USB 3.0 electrical connection plug 103 and the two contact interfaces of the dual-position duplex electrical connection plug 123 can be integrated and switched mutually. That is, different connection points of the male and female contact interfaces can be integrated and switched mutually.

Figure 35:
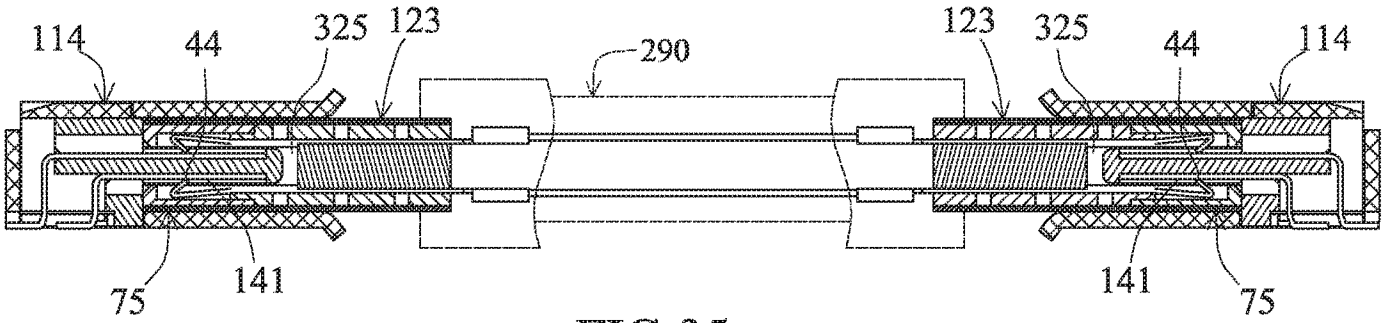
FIG. 35 is a side cross-sectional view according to an eleventh embodiment of the invention.

Referring to FIG. 35, the eleventh embodiment of the invention is a transmission cable 290 and is substantially the same as the tenth embodiment except for the difference that two ends of the transmission cable 290 of this embodiment are connected to a dual-position duplex electrical connection plug 123.

Figure 36:
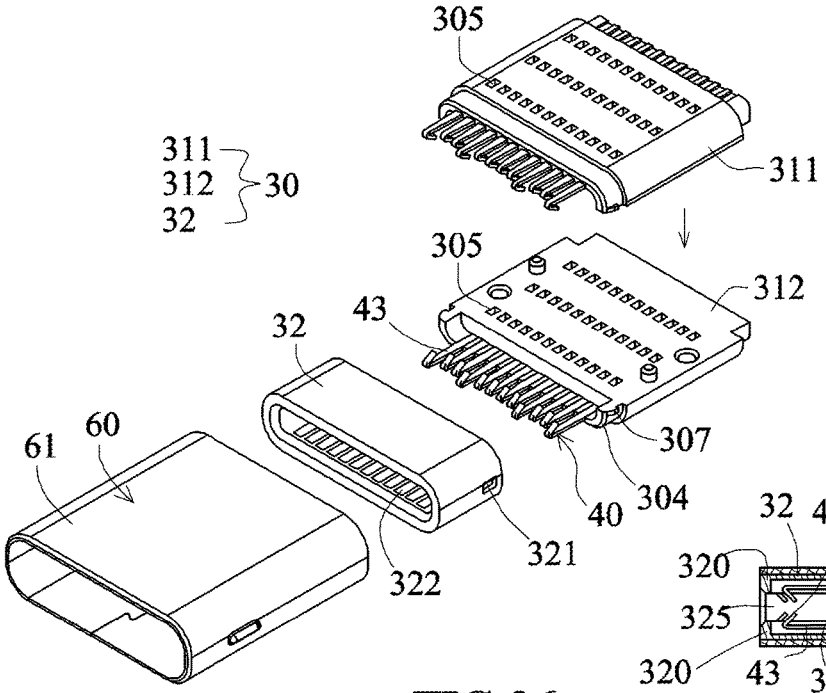
FIG. 36 is a pictorially exploded view according to a twelfth embodiment of the invention.
Figure 37:
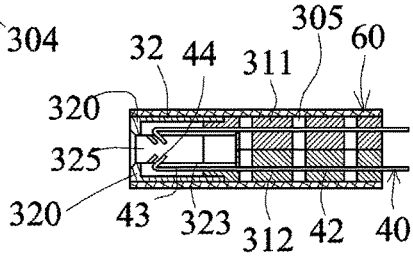
FIG. 37 is a side cross-sectional view according to the twelfth embodiment of the invention.

Referring to FIG. 36 and FIG. 37, the twelfth embodiment of the invention is a dual-position duplex electrical connection plug, and is substantially the same as the ninth embodiment except for the difference that the base seat of the insulated seat 30 is the same as the first embodiment and similarly provided with the vertically stacked first and second base seats 311 and 312, that the first and second base seats 311 and 312 are respectively integrally embedded and injection molded with one row of first terminals 40, that each of the first and second base seats 311 and 312 is formed with three rows of through holes 305, and that each through hole 305 corresponds to and penetrates through the fixing portion 42 of the first terminal 40. That is, some fixing portions 42 of the two rows of first terminals 40 are respectively embedded into the first and second base seats 311 and 312, wherein the two terminal sets substantially the same as the ninth embodiment.

In addition, the jointing portion 304 of the front end of the base seat is a hollow frame body, which is formed by stacking the inverse-U shaped frame body and the U-shaped frame body together so that the extensions 43 of the two rows of first terminals 40 may have the shorter elastically movable arm of force, and that the contact 44 has the larger normal force.

Figure 38:
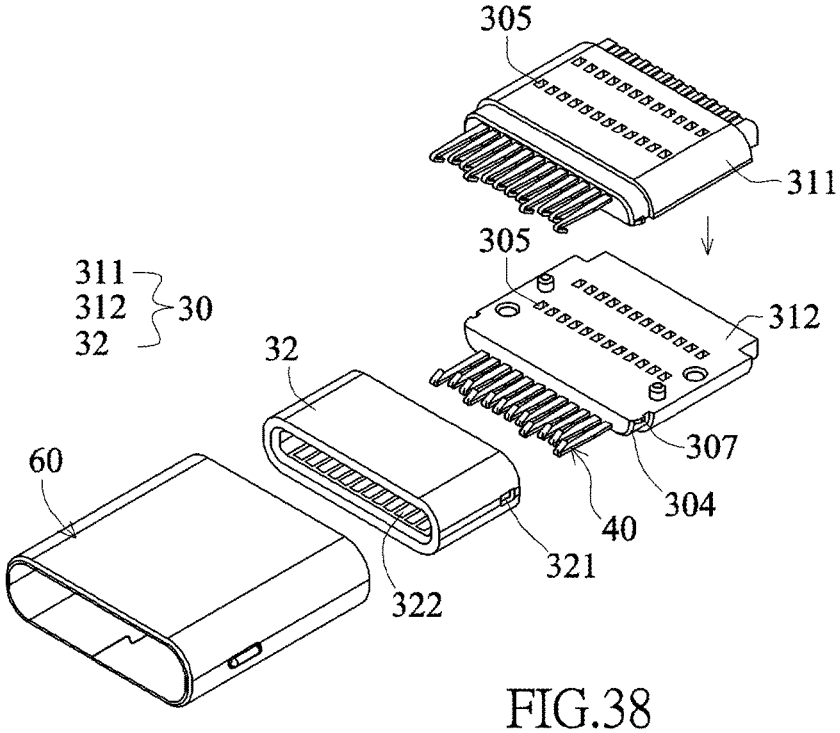
FIG. 38 is a pictorially exploded view according to a thirteenth embodiment of the invention.
Figure 40:
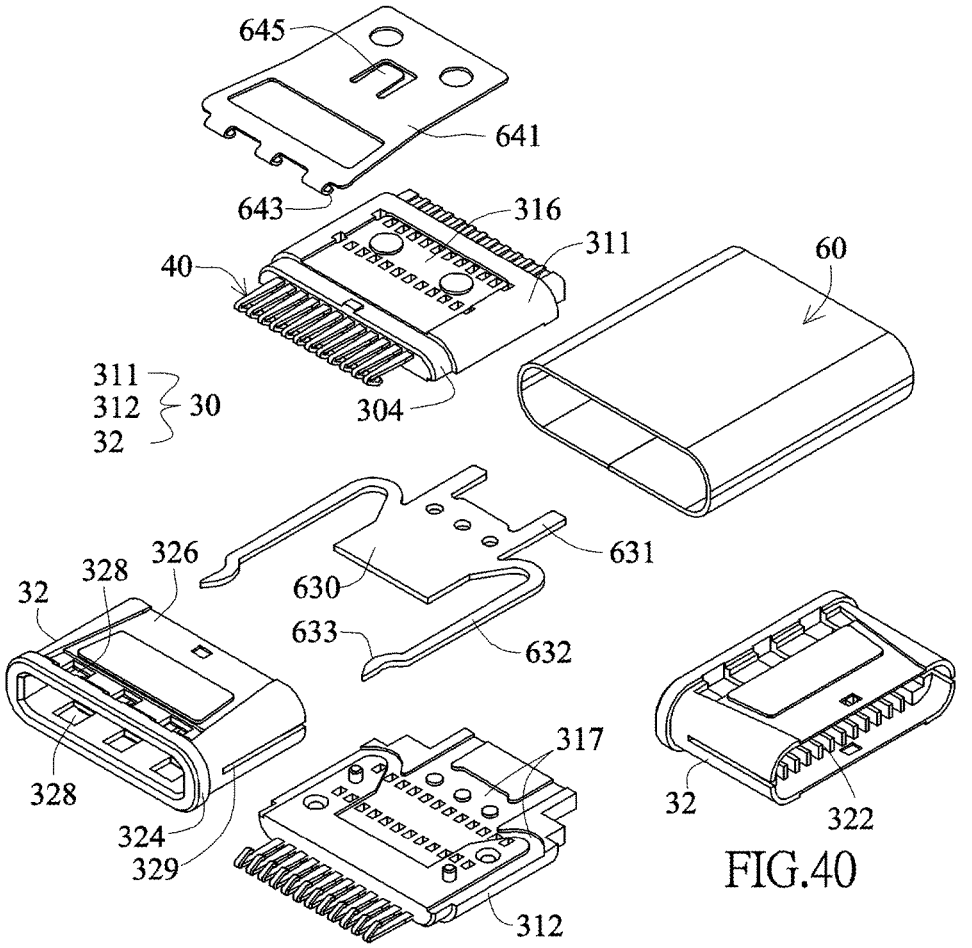
FIG. 40 is a pictorial view showing the fitting member according to the 14th embodiment of the invention.
Figure 39:
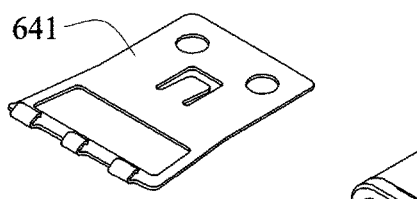
FIG. 39 is a pictorially exploded view according to a 14th embodiment of the invention.
Figure 41:
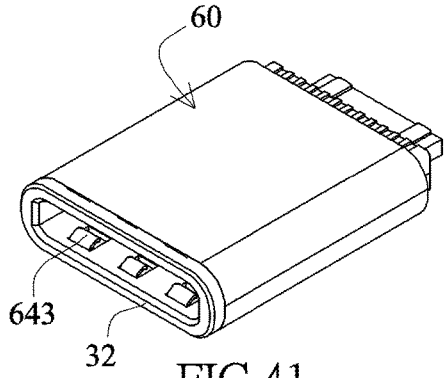
FIG. 41 is a pictorially assembled view according to the 14th embodiment of the invention.
Figure 42:
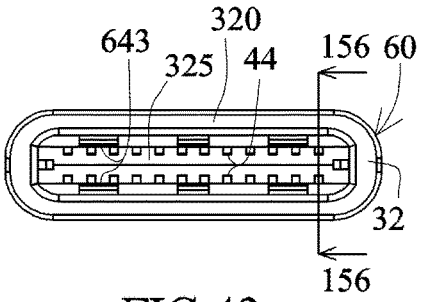
FIG. 42 is a pictorial front view according to the 14th embodiment of the invention.
Figure 43:
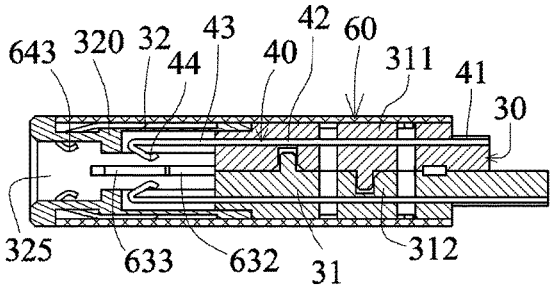
FIG. 43 is a side cross-sectional view according to the 14th embodiment of the invention.
Figure 44:
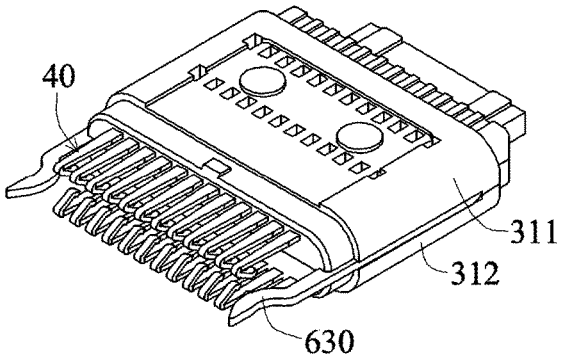
FIG. 44 is a pictorially assembled view showing the upper seat, the metal partition plate and the lower seat according to the 14th embodiment of the invention.
Figure 45:
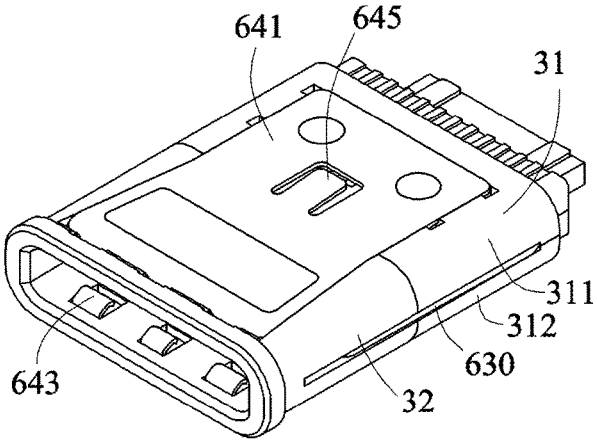
FIG. 45 is a pictorially assembled view (when the metal housing is not assembled) according to the 14th embodiment of the invention.

Referring to FIG. 38, the thirteenth embodiment of the invention is substantially the same as the twelfth embodiment except for the difference that the jointing portion 304 of the front end of the base seat of the insulated seat 30 is physical, so that the length of the docking part 32 needs to be longer than that of the twelfth embodiment. In addition, the extensions 43 of the two rows of first terminals 40 also need the longer elastically movable arm of force, so that the extensions of the two rows of first terminals 40 have the better resilience, but the normal force of the contact is decreased.

Referring to FIGS. 39 to 45, the 14th embodiment of the invention is a dual-position duplex USB TYPE-C electrical connection plug, and is substantially the same as the plug of the first embodiment and the twelfth embodiment except for the difference that: each of the outsides of the first and second base seats 311 and 312 of the base seat of the insulated seat 30 is provided with a concave surface 316; each of the top and bottom surfaces of the docking part 32 is provided with a concave surface 326, the front section of the concave surface 326 is provided with three openings 328, each of the left and right sides is provided with an opening 329, and the front end is provided with a convex ring 324 flush with the metal housing 60; the metal partition plate 630 and the two resilient snaps 632 of the left and right sides are on the same plane, the two resilient snaps 632 contact the metal housing 60 and extend into the connection slot 325 from the notches 329 of the left and right sides of the fitting member 320; and the two ground shielding sheets 641 are not integrally formed together and are separated from each other, the two ground shielding sheets 641 are respectively assembled and engaged with the concave surface 316 of the first and second base seats 311 and 312 and the top and bottom surfaces of the docking part 32, and each of the two ground shielding sheets 641 is provided with a projecting elastic sheet 645 resiliently resting against the metal housing 60.

Figure 46:
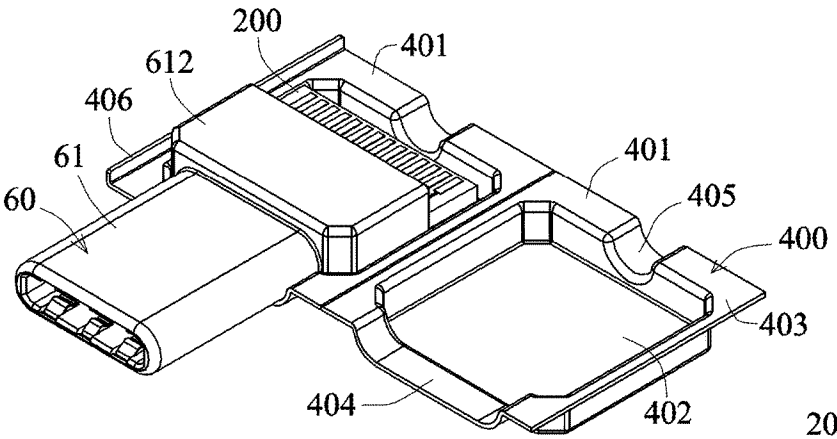
FIG. 46 is a pictorial view showing the open state of the rear shielding shell according to a 15th embodiment of the invention.

Referring to FIG. 46, the 15th embodiment of the invention is a dual-position duplex USB TYPE-C electrical connection plug, and is substantially the same as FIG. 15D of the first embodiment except for the difference that the convex shell 612 of the metal housing 60 is longer.

Figure 47:
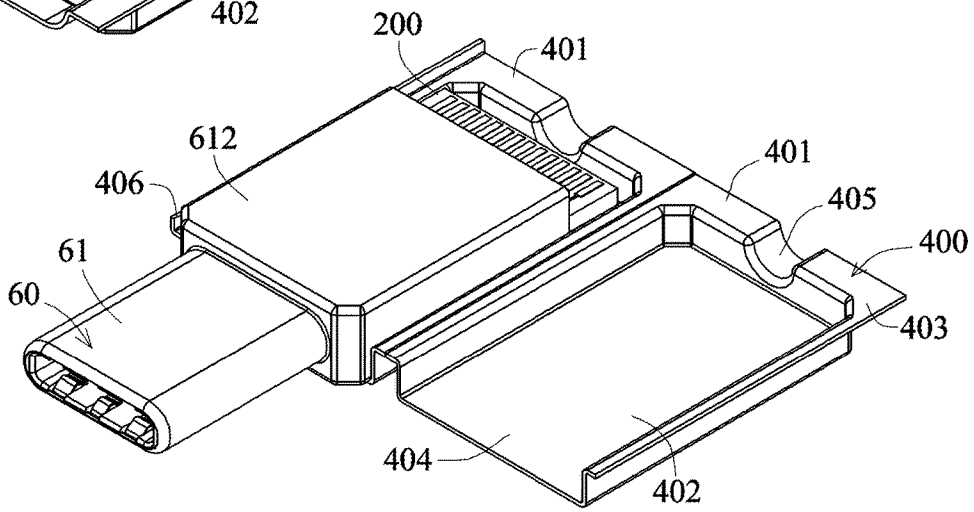
FIG. 47 is a pictorial view showing the open state of the rear shielding shell according to a 16th embodiment of the invention.

Referring to FIG. 47, the 16th embodiment of the invention is a dual-position duplex USB TYPE-C electrical connection plug, and is substantially the same as the 15th embodiment except for the difference that the fitting port 404 of the rear shielding shell 400 is fitted with the convex shell 612, and the fitting port 404 is flush with the height of the accommodating space.

Figure 48:
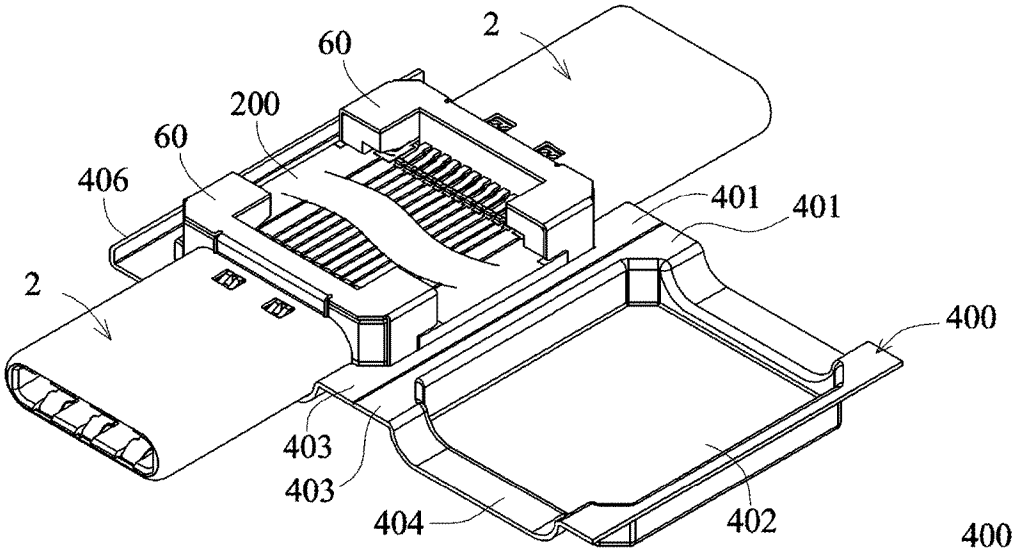
FIG. 48 is a pictorial view showing the open state of the rear shielding shell according to a 17th embodiment of the invention.
Figure 49:
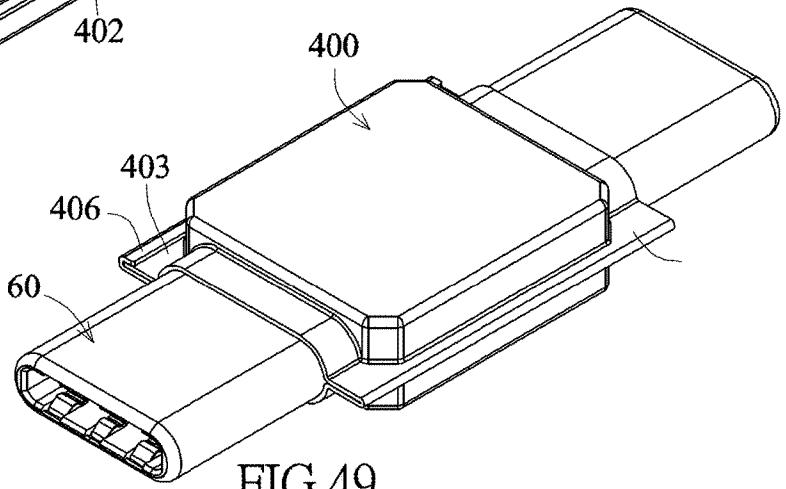
FIG. 49 is a pictorial view showing the closed state of the rear shielding shell according to the 17th embodiment of the invention.

Referring to FIGS. 48 and 49, the 17th embodiment of the invention is an adapter, and each of two ends of the adapter is a dual-position duplex USB TYPE-C electrical connection plug 2. Two terminal sets of the two dual-position duplex USB TYPE-C electrical connection plugs 2 are electrically connected to the circuit board 200, through which the adaptation is made. The rear sections of the metal housings 60 of the two dual-position duplex USB TYPE-C electrical connection the plugs 2 are covered by the same rear shielding shell 400. The rear shielding shell 400 is substantially the same as the FIG. 15D except for the difference that the length of the rear shielding shell 400 is longer and the front and rear ends thereof are fitting ports 404.

Two ends of the implemented adapter may also be a plug and a socket, respectively, or sockets, or any other type of plug or socket.

Figure 50:
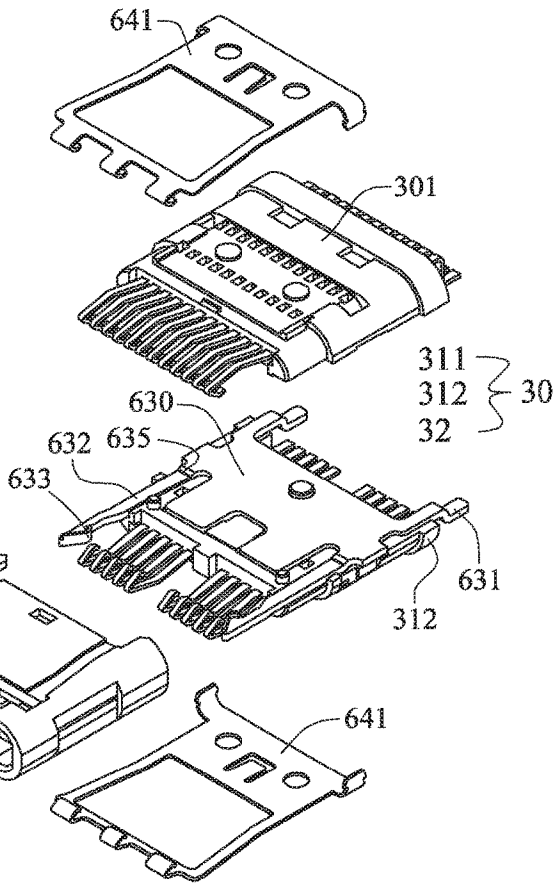
FIG. 50 is a pictorially exploded view according to an 18th embodiment of the invention.
Figure 51:
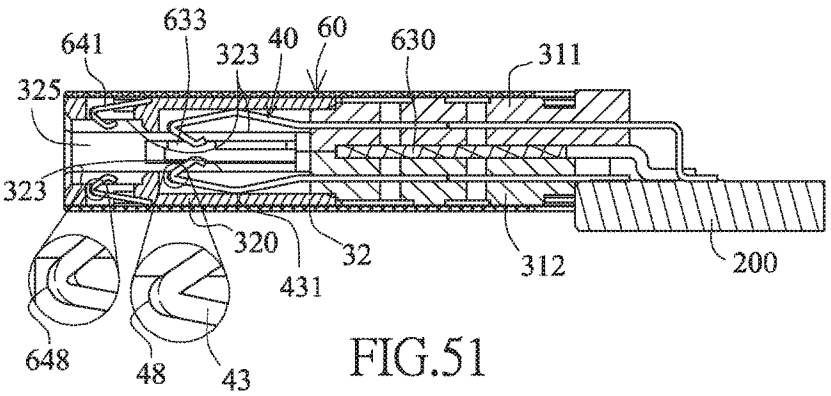
FIG. 51 is a side cross-sectional view according to the 18th embodiment of the invention.

Referring to FIGS. 50 and 51, the 18th embodiment of the invention is a dual-position duplex USB TYPE-C electrical connection plug, and is substantially the same as the 14th embodiment except for the difference that the fulcrums 431 of the extensions 43 of the two rows of first terminals 40 rest against the connection plate 320, so that the elastically movable arm of force has the high structural strength and the good resilience, that the contact 44 has the larger normal force, and that a bent angle 48 formed by reversely bending the end section of the extension 43 can be machined by the secondary machining to form a structure smaller than the naturally bent arc (see dashed lines). Thus, the bent angle 48 cannot project beyond the rear section of the connection surface 323. The bent angle 648 of the ground shielding sheet 641 is also machined by the secondary machining to form a structure smaller than the naturally bent arc (see dashed lines), so that the bent angle 648 cannot project beyond the front section of the connection surface 323, and can be used more smoothly.

In addition, the pins of the two terminal sets are electrically connected to a circuit board 200. The circuit board 200 may be provided with associated electrical elements or circuit protecting electrical elements. The circuit board 200 may be electrically connected to an electronic unit. The pins of the two sets of terminals and the electronic unit form the electrical connection through the circuit board.

Furthermore, the snapping convex portion 633 of the resilient snap 632 is formed by drawing and pulling a plate surface to have a larger height greater than the thickness of the metal partition plate 630. The section of the resilient snap 632 is provided with a bent portion 635 so that a vertical step is formed between the front section and the rear end, and that the middle height of the snapping convex portion 633 is substantially disposed at the middle thickness of the metal partition plate 630.

Figure 52:
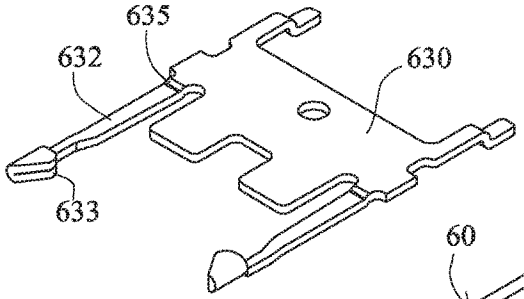
FIG. 52 is a pictorial view showing another variation of the metal partition plate according to the 18th embodiment of the invention.

Referring to FIG. 52 showing another variation of this embodiment, the snapping convex portion 633 is formed by stacking two plate surfaces of the resilient snap 632 to have the larger height.

Figure 53:
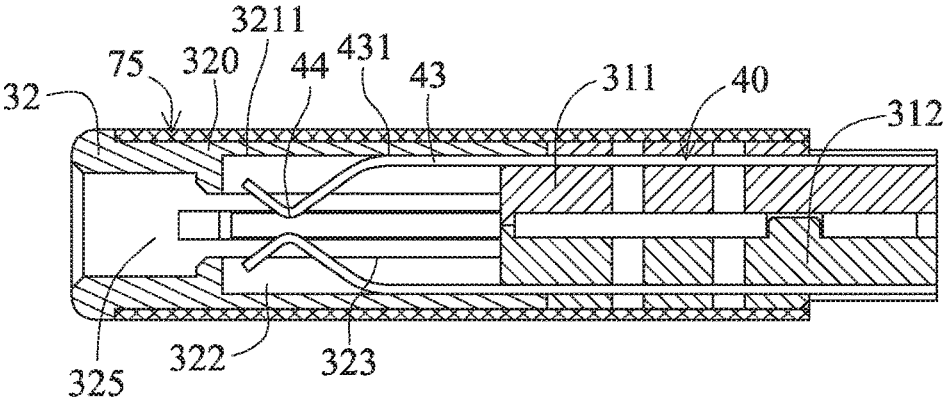
FIG. 53 is a side cross-sectional view according to a 19th embodiment of the invention.
Figure 54:
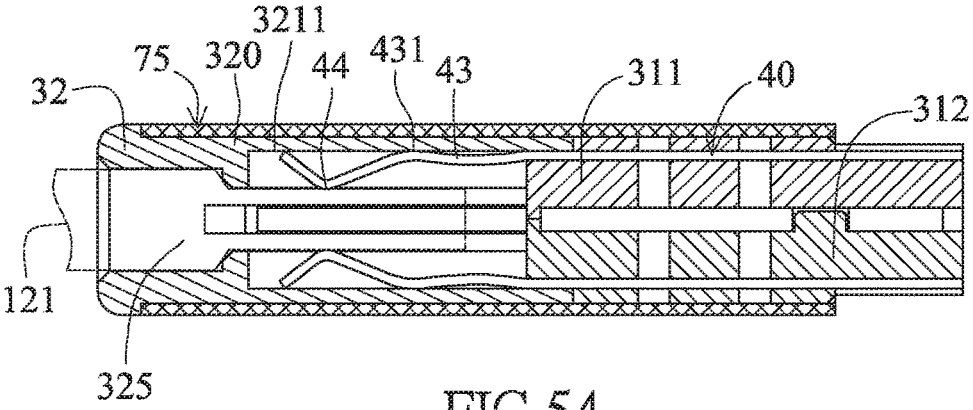
FIG. 54 is a diagram showing the implemented state according to the 19th embodiment of the invention.

Referring to FIG. 53 and FIG. 54, the 19th embodiment of the invention is a dual-position duplex USB TYPE-C electrical connection plug, and is substantially the same as the 14th embodiment except for the difference that the extensions 43 of the inner ends of the contacts 44 of the two rows of first terminals 40 of this embodiment are provided with a fulcrum 431 resting against the bottom surface 3211 of the elastic movement space 322, the extension 43 of the inner end of the fulcrum 431 is in flat surface contact with the bottom surface 3211. The extension 43 of the outer end of the fulcrum 431 does not rest against the bottom surface 3211. Referring to FIG. 54, when the connection slot 325 is connected to the tongue 121 of the socket and the contact 44 is pressed to elastically move toward the bottom surface 3211, the contact 44 has the larger normal force with the action of the fulcrum 431. Meanwhile, the extension 43 of the inner end of the fulcrum 431 elastically moves reversely, so the good resilience still can be obtained.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A reversible dual-position electric connector, comprising:

an insulated seat provided with a base seat and a docking part fitting with each other, wherein the docking part is provided with two connection plates facing each other in a vertical direction, and is provided with two side plates connected to the two connection plates to form a fitting frame body, each of opposite surfaces of the two connection plates is provided with a connection surface, and a connection slot is formed between the two connection surfaces, wherein at least one of the connection plates is provided with one or multiple elastic movement spaces much more depressed than the connection surface, and a rear end of the docking part is fitted with and positioned at a front end of the base seat;

one or multiple terminal sets disposed in the insulated seat, wherein the terminal set or each of the terminal sets is provided with at least one row of terminals, the terminal is provided with a fixing portion and an extension, the fixing portion is fixed to the base seat, the extension is directly connected to a front end of the fixing portion, the fixing portion is directly fixed to the base seat, and the extension extends out of the front end of the base seat, wherein after the at least one row of terminals are fixed to and combined with the base seat to form a total combination comprising the at least one row of terminals and the base seat combined together, the base seat is fitted with and positioned at the docking part, so that the docking part can be independently fitted with and positioned at, or separated from the total combination, wherein the extension is vertically elastically movable relatively to the docking part, the extension extends to the one or multiple elastic movement spaces of one of the connection surfaces and is provided with a contact projecting beyond the connection surface, the contact is vertically elastically movable, and the contacts of the terminals of each of the terminal sets project from the one of the connection surfaces to the connection slot; and a metal housing covering the insulated seat and provided with a four-sided primary housing, wherein the four-sided primary housing shields the docking part to form a docking structure, a shape of the docking structure can be positioned at a docking electric connector in a reversible dual-position manner, the metal housing and the two connection plates form two contact interface substrates, and the contact interface substrate has a height, which is a perpendicular distance from an outer surface of the metal housing to the connection surface, wherein the heights of the two contact interface substrates are smaller than a height of a fitting interface substrate of a biased electrical connection plug having a minimum height specification of 0.9 mm specified by USB Association and larger than or equal to 0.65 mm.

2. The reversible dual-position electric connector according to claim 1, characterized in that the terminal sets comprise two terminal sets, wherein the contacts of the terminals of the two terminal sets are disposed on the two connection surfaces, respectively.

3. The reversible dual-position electric connector according to claim 2, characterized in that the insulated seat is positioned and provided with two ground shielding sheets each made of a metal material, each of the two ground shielding sheets, which form a gap, is provided with at least one contact, and the contacts are respectively exposed from the two connection surfaces.

4. The reversible dual-position electric connector according to claim 3, characterized in that the two ground shielding sheets are integrally connected together to form a ground shielding member.

5. The reversible dual-position electric connector according to claim 4, characterized in that the reversible dual-position electric connector is one of (a) to (d) or a combination of more than one of (a) to (d):

(a) wherein two sides of the two ground shielding sheets of the ground shielding member are connected together through two side sheets to form a four-sided housing, the ground shielding member is fitted with and positioned outside the insulated seat, and each of the two connection plates is provided with one or multiple openings, through which the contacts of the two ground shielding sheets respectively pass and are exposed from the two connection surfaces;

(b) wherein the contacts of the two ground shielding sheets are made of elastic sheets bent reversely from front ends and are projectingly curved, and the contacts of the two ground shielding sheets respectively project beyond the two connection surfaces and are vertically elastically movable;

(c) wherein the contacts of the two ground shielding sheets respectively project beyond the two connection surfaces and are vertically elastically movable; and (d) wherein the two connection surfaces have front sections and rear sections higher than the front sections so that the connection slot forms a front section and a rear section lower than the front section, the contacts of the two ground shielding sheets are respectively exposed from the front sections of the two connection surfaces, and the contacts of the two terminal sets are respectively exposed from the rear sections of the two connection surfaces and are closer to a middle height of the connection slot than the contacts of the two ground shielding sheets.

6. The reversible dual-position electric connector according to claim 2, characterized in that a middle of the base seat of the insulated seat is provided with a metal partition plate, the metal partition plate separates the two terminal sets, each of two sides of the metal partition plate is integrally provided with a resilient snap, and the two resilient snaps are elastically movable in a left-right direction and each of portions near free ends of the two resilient snaps is provided with a snapping convex portion laterally convex inwards, wherein the snapping convex portions are disposed on two sides of the connection slot.

7. The reversible dual-position electric connector according to claim 6, characterized in that the reversible dual-position electric connector is one of (a) to (c) or a combination of more than one of (a) to (c):

(a) wherein the metal partition plate is provided with at least one pin for electrical connections to form ground shielding;

(b) wherein a rear end of the resilient snap has a plate surface perpendicularly connected to the metal partition plate; and (c) wherein the snapping convex portion is substantially disposed at a middle height of the connection slot.

8. The reversible dual-position electric connector according to claim 6, characterized in that a height of the snapping convex portion is greater than a material thickness of the metal partition plate, the resilient snap is provided with a bent portion so that a vertical step is formed between a front section of the resilient snap and the rear end of the resilient snap.

9. The reversible dual-position electric connector according to claim 8, characterized in that the reversible dual-position electric connector is one of (a) to (d) or a combination of more than one of (a) to (d):

(a) wherein the rear end of the resilient snap has a plate surface perpendicularly connected to the metal partition plate;

(b) wherein the plate surface of the resilient snap and a plate surface of the metal partition plate have the same thickness and are disposed on the same plane, and the snapping convex portion is formed by drawing and pulling a plate surface to form a larger height;

(c) wherein the snapping convex portion is formed by stacking two plate surfaces of the resilient snap to form a larger height; and (d) wherein a middle height of the snapping convex portion is substantially disposed at a middle thickness of the metal partition plate.

10. The reversible dual-position electric connector according to claim 2, characterized in that a rear end of the base seat of the insulated seat is provided with a fitting slot, the fitting slot is snapped to and positioned with a circuit board, the circuit board is provided with multiple circuit connection points, and the terminals of the two terminal sets are provided with pins electrically connected to the circuit connection points, respectively.

11. The reversible dual-position electric connector according to claim 2, characterized in that the reversible dual-position electric connector is one of (a) to (g) or a combination of more than one of (a) to (g):

(a) wherein a middle of the base seat of the insulated seat is provided with a metal partition plate, and the metal partition plate separates the two terminal sets;

(b) wherein the contacts of the two terminal sets have the same contact interface;

(c) wherein the four-sided primary housing of the metal housing is top-bottom symmetrical and left-right symmetrical;

(d) wherein the two terminal sets are fixedly embedded into and injected molded with the insulated seat;

(e) wherein the contacts of the two terminal sets having the connection points with the same circuit serial numbers are arranged reversely;

(f) wherein the contacts of the two terminal sets are vertically aligned; and (g) wherein the contacts of the two terminal sets are arranged in an equally spaced manner.

12. The reversible dual-position electric connector according to claim 1, characterized in that a total height of the docking structure is smaller than a total height obtained by adding a height of the fitting slot and a double of a height of the fitting interface substrate of the biased electrical connection plug having the minimum height specification specified by USB Association.

13. The reversible dual-position electric connector according to claim 1, characterized in that the at least one connection surface is projectingly provided with one front row of contacts and one rear row of contacts, the two rows of contacts are vertically elastically movable, and at least one row of contacts of the two rows of contacts are the contacts of the terminal set.

14. The reversible dual-position electric connector according to claim 1, characterized in that the terminal sets comprise two terminal sets, the contacts of the terminals of the two terminal sets respectively project beyond the two connection surfaces, the base seat of the insulated seat is provided with a first base seat and a second base seat stacked together, and the two terminal sets are respectively embedded into, injection molded with and fixedly disposed on the first and second base seats, wherein the first base seat and one terminal set of the two terminal sets form a first combination, the second base seat and the other terminal set of the two terminal sets form a second combination, and the first combination and the second combination are mutually stacked together to form the total combination.

15. The reversible dual-position electric connector according to claim 1, characterized in that the reversible dual-position electric connector is one of (a) to (i) or a combination of more than one of (a) to (i):

(a) wherein the one or multiple elastic movement spaces of the connection plate have one or multiple bottom surfaces separated from the metal housing;

(b) wherein a front of the base seat is provided with a jointing portion, a front end of the docking part is an inserting port and a rear end of the docking part is a fitting port, and the fitting port is fitted with the jointing portion;

(c) wherein a front of the base seat is provided with the jointing portion, a front end of the docking part is the inserting port and a rear end of the docking part is the fitting port, the fitting port is fitted with the jointing portion, two sides of the jointing portion are provided with two frontwardly projecting side portions, and a notch is formed between the two side portions;

(d) wherein the insulated seat is positioned and provided with two ground shielding sheets each made of a metal material, each of two front ends of the two connection plates of the docking part or each of portions near the two front ends of the two connection plates of the docking part is provided with an opening, each of the two ground shielding sheets, which form a gap, is provided with at least one contact, and the contacts respectively pass through the openings of the two connection plates and project beyond the two connection surfaces and are vertically elastically movable;

(e) wherein the docking part comprises upper and lower housings connected together, the upper and lower housings are respectively embedded into a ground shielding sheet made of a metal material, each of the two ground shielding sheets is provided with at least one contact and the contacts respectively project beyond the two connection surfaces, and the contacts of the two ground shielding sheets are vertically elastically movable;

(f) wherein a middle of the base seat of the insulated seat is provided with a metal partition plate, each of two sides of the metal partition plate is integrally provided with a resilient snap, the two resilient snaps are elastically movable in a left-right direction and portions near two free ends of the two resilient snaps are provided with two snapping convex portions disposed on two sides of the connection slot, each of two sides of the docking part is provided with an opening, and when the two resilient snaps elastically move in the left-right direction, the two openings can provide spaces for the two resilient snaps;

(g) wherein the docking part comprises upper and lower housings connected together, and the upper and lower housings are respectively embedded into a reinforcement sheet;

(h) wherein each of left and right sides of the docking part is provided with a snap made of a metal material; and (i) wherein the at least one connection plate is provided with barriers for separating the elastic movement space into one row of small elastic movement spaces separately arranged.

16. The reversible dual-position electric connector according to claim 1, characterized in that the reversible dual-position electric connector is further provided with a rear shielding shell, the rear shielding shell is made of a metal material and covers a rear section of the metal housing and a rear section of the insulated seat, an accommodating space is formed in the rear shielding shell and a front end of the rear shielding shell is provided with a fitting port, and the fitting port is fitted with the rear section of the metal housing, wherein the rear shielding shell is provided with upper and lower seamless chambers, and the seamless chambers of the two housings form the accommodating space.

17. The reversible dual-position electric connector according to claim 16, characterized in that the rear shielding shell is composed of two housings vertically combined together, each of the housings is provided with the seamless chamber, and a periphery of the chamber is provided with one or multiple combination plates, and the one or multiple combination plates of the two housings are vertically combined together.

18. The reversible dual-position electric connector according to claim 1, characterized in that the reversible dual-position electric connector is one of (a) to (d) or a combination of more than one of (a) to (d):

(a) wherein a second metal shell is provided to rest against the metal housing, the second metal shell is provided with a four-sided housing, and the four-sided housing is fitted with and rests against the four-sided primary housing;

(b) wherein the two connection plates have the same height;

(c) wherein a coating is further provided to cover a rear section of the metal housing; and (d) wherein each of left and right sides of the docking part is provided with a snap made of a metal material.

19. The reversible dual-position electric connector according to claim 1, characterized in that the elastic movement space is provided with a bottom surface, an extension of an inner end of the contact of the terminal is provided with a fulcrum resting against the bottom surface, an extension of an outer end of the fulcrum does not rest against the bottom surface, and when the contact is pressed to elastically move toward the bottom surface, the contact has a larger normal force by an action of the fulcrum.

20. The reversible dual-position electric connector according to claim 1, characterized in that the reversible dual-position electric connector is further provided with an adapter medium adapted to an adapted electric connector.

21. The reversible dual-position electric connector according to claim 20, characterized in that the reversible dual-position electric connector is one of (a) to (d) or a combination of more than one of (a) to (d):

(a) wherein the reversible dual-position electric connector further comprises a connection point switching integrated device, so that a contact interface of the reversible dual-position electric connector and a contact interface of the adapted electric connector can be integrated and switched mutually;

(b) wherein the adapted electric connector is a plug or a socket that can be inserted at dual positions;

(c) wherein the adapter medium is an adapter cable or a circuit board; and (d) wherein the adapted electric connector is a plug.

22. The reversible dual-position electric connector according to claim 1, characterized in that at least one of the connection plates is provided with multiple separate barriers separating the elastic movement spaces to form one row of smaller elastic movement spaces, the connection plate is integrally provided with an insulating layer functioning as a bottom surface of the elastic movement space separated from the metal housing.

23. A reversible dual-position electric connector, comprising:

an insulated seat provided with a base seat and a docking part, wherein the docking part is disposed on a front end of the base seat, the docking part is provided with two connection plates facing each other in a vertical direction, each of opposite surfaces of the two connection plates is provided with a connection surface, and a connection slot is formed between the two connection surfaces;

one or multiple terminal sets disposed in the insulated seat, wherein the terminal set or each of the terminal sets is provided with at least one row of terminals, the terminal is provided with a fixing portion and an extension, the fixing portion is fixed to the base seat, the extension is connected to a front end of the fixing portion, the extension extends to the one of the connection surfaces and is provided with a contact, and the contacts of the terminals of each of the terminal sets are exposed from one of the connection surfaces;

a metal housing covering the insulated seat and provided with a four-sided primary housing, wherein the four-sided primary housing shields the docking part to form a docking structure, and a shape of the docking structure can be positioned at a docking electric connector in a reversible dual-position manner; and a rear shielding shell, which is made of a metal material and covers a rear section of the metal housing and a rear section of the insulated seat, wherein an accommodating space is formed in the rear shielding shell and a front end of the rear shielding shell is provided with a fitting port, the fitting port is fitted with the rear section of the metal housing, the rear shielding shell is provided with upper and lower seamless chambers, and the two seamless chambers form the accommodating space, wherein the rear shielding shell is composed of two housings vertically combined together, each of the housings is provided with the seamless chamber, and a periphery of the chamber is provided with one or multiple combination plates, and the one or multiple combination plates of the two housings are vertically combined together.

24. The reversible dual-position electric connector according to claim 23, characterized in that the reversible dual-position electric connector is one of (a) to (h) or a combination of more than one of (a) to (h):

(a) wherein a rear end of the rear shielding shell is provided with a fitting port;

(b) wherein the upper and lower seamless chambers of the two housings of the rear shielding shell are formed by a metal sheet and by way of drawing extension molding, are formed by way of metal die casting, or are formed by way of metal powder injection molding;

(c) wherein two of left and right sides of the upper and lower seamless chambers of the rear shielding shell are integrally connected together, and the other of the left and right sides of the two housings of the rear shielding shell are stacked together;

(d) wherein a circuit board and an electronic unit are disposed in the rear shielding shell, the terminals of the one or multiple terminal sets and the electronic unit are electrically connected to the circuit board, and the terminals of the one or multiple terminal sets and the electronic unit form electrical connections through the circuit board;

(e) wherein the rear section of the metal housing is integrally provided with a convex shell more convex in a top-bottom direction than the four-sided primary housing, the fitting port is fitted with a rear section of the four-sided primary housing, and a height of the fitting port is smaller than a height of the accommodating space;

(f) wherein the rear section of the metal housing is integrally provided with the convex shell more convex in the top-bottom direction than the four-sided primary housing, and the fitting port is fitted with the convex shell;

(g) wherein a rear end of the rear shielding shell is provided with another fitting port, the another fitting port is fitted with a rear section of a metal housing of a docking electric connector, a circuit board is disposed in the rear shielding shell, the terminals of the one or multiple terminal sets and the docking electric connector are electrically connected to the circuit board, the terminals of the one or multiple terminal sets and the docking electric connector form electrical connections through the circuit board so that mutual adaptation is achieved; and (h) wherein the multiple terminal sets are two terminal sets, and the contacts of the terminals of the two terminal sets are disposed on the two connection surfaces, respectively.

25. The reversible dual-position electric connector according to claim 23, characterized in that the reversible dual-position electric connector is one of (a) to (d) or a combination of more than one of (a) to (d):

(a) wherein the combination plate of the housing of the rear shielding shell is provided with a snapping sheet snapping to the combination plate of the other housing;

(b) wherein the combination plate of the housing of the rear shielding shell is perpendicularly provided with one or multiple bending edges shielding an outside of the combination plate of the other housing;

(c) wherein the one or multiple combination plates of the two housings of the rear shielding shell are hot molten and combined by way of laser welding so that a combination portion forms a seamless combination, or the combination plates of the two housings are locally spot welded and combined together; and (d) wherein the two combination plates on first sides of the two housings of the rear shielding shell are integrally connected together and can be folded and combined together.

26. A reversible dual-position electric connector, comprising:

an insulated seat provided with a base seat and a docking part, wherein the docking part is disposed on a front end of the base seat, the docking part is provided with two connection plates facing each other in a vertical direction and provided with two side plates connected to the two connection plates to form a fitting frame body, each of opposite surfaces of the two connection plates is provided with a connection surface, a connection slot is formed between the two connection surfaces, and a front end of the fitting frame body is an inserting port;

one or multiple terminal sets disposed in the insulated seat, wherein the terminal set or each of the terminal sets is provided with at least one row of terminals, the terminal is provided with a fixing portion and an extension, the fixing portion is fixed to the base seat, the extension is connected to a front end of the fixing portion, the extension extends to a connection surface and is provided with a contact, and the contacts of the terminals of each of the terminal sets are exposed from one of the connection surfaces; and a metal housing covering the insulated seat and provided with a four-sided primary housing, the four-sided primary housing shields the docking part to form a docking structure, and a shape of the docking structure can be positioned at a docking electric connector in a reversible dual-position manner;

characterized in that the docking part in the form of the fitting frame body is embedded with at least one grounding member made of a metal material, the grounding member contacts the metal housing and is provided with at least one contact projecting beyond the connection slot from the one connection surface, and the at least one contact of the grounding member is vertically movable, wherein at least one portion of the grounding member is totally embedded into a front section of the fitting frame body to reinforce a structural strength of the inserting port of the fitting frame body.

27. The reversible dual-position electric connector according to claim 26, characterized in that the reversible dual-position electric connector is one of (a) to (c) or a combination of more than one of (a) to (c):

(a) wherein the grounding member is a ground shielding sheet, and the contacts of the two grounding members project from the two jointing surfaces to the connection slot;

(b) wherein the two connection plates are embedded with the grounding members;

(c) wherein the at least one connection plate has at least one opening, and the at least one contact of the grounding member passes through the at least one opening and projects to the connection slot;

(d) wherein the at least one contact of the grounding member extends backwards from an insert port of the connection slot;

(e) wherein the multiple terminal sets are two terminal sets, and the contacts of the terminals of the two terminal sets are disposed on the two jointing surfaces, respectively; and (f) wherein the at least one connection plate has one row of separate elastic movement spaces much more depressed than the jointing surface, and has multiple barriers separating the neighboring elastic movement spaces, the extensions of the terminals of each of the terminal sets extend to the elastic movement spaces, the contacts of the terminals project beyond the jointing surface, the contact is vertically movable, the contacts of the terminals of each of the terminal sets project from one of the jointing surfaces to the connection slot, and the elastic movement spaces of the connection plate have bottom surfaces separated from the metal housing.

28. A reversible dual-position electric connector, comprising:

an insulated seat provided with a base seat and a docking part fitting with each other, wherein the docking part is provided with two connection plates facing each other in a vertical direction, and is provided with two side plates connected to the two connection plates to form a fitting frame body, each of opposite surfaces of the two connection plates is provided with a connection surface, and a connection slot is formed between the two connection surfaces, wherein at least one of the connection plates is provided with one or multiple elastic movement spaces much more depressed than the connection surface, and a rear end of the docking part is fitted with and positioned at a front end of the base seat;

one or multiple terminal sets disposed in the insulated seat, wherein the terminal set or each of the terminal sets is provided with at least one row of terminals, the terminal is provided with a fixing portion and an extension, the fixing portion is fixed to the base seat, the extension is directly connected to a front end of the fixing portion, the fixing portion is directly fixed to the base seat, and the extension extends out of the front end of the base seat, wherein after the at least one row of terminals are fixed to and combined with the base seat to form a total combination comprising the at least one row of terminals and the base seat combined together, the base seat is fitted with and positioned at the docking part, so that the docking part can be independently fitted with and positioned at, or separated from the total combination, wherein the extension is vertically elastically movable relatively to the docking part, the extension extends to the one or multiple elastic movement spaces of one of the connection surfaces and is provided with a contact projecting beyond the connection surface, the contact is vertically elastically movable, and the contacts of the terminals of each of the terminal sets project from the one of the connection surfaces to the connection slot; and a metal housing covering the insulated seat and provided with a four-sided primary housing, wherein the four-sided primary housing shields the docking part to form a docking structure, a shape of the docking structure can be positioned at a docking electric connector in a reversible dual-position manner, the metal housing and the two connection plates form two contact interface substrates, and the contact interface substrate has a height, which is a perpendicular distance from an outer surface of the metal housing to the connection surface, wherein the terminal sets comprise two terminal sets, the contacts of the terminals of the two terminal sets respectively project beyond the two connection surfaces, the base seat of the insulated seat is provided with a first base seat and a second base seat stacked together, and the two terminal sets are respectively embedded into, injection molded with and fixedly disposed on the first and second base seats, wherein the first base seat and one terminal set of the two terminal sets form a first combination, the second base seat and the other terminal set of the two terminal sets form a second combination, the first combination and the second combination are mutually stacked together to form the total combination, and both the first base seat and the second base seat rest against the metal housing.

29. The reversible dual-position electric connector according to claim 28, characterized in that the heights of the two contact interface substrates are smaller than a height of a fitting interface substrate of a biased electrical connection plug having a minimum height specification of 0.9 mm specified by USB Association and larger than or equal to 0.65 mm.

* * * * *